US007669375B2

(12) United States Patent
Everett

(10) Patent No.: US 7,669,375 B2
(45) Date of Patent: Mar. 2, 2010

(54) STRUCTURAL BUILDING BLOCK SYSTEM WITH ENHANCED LOAD BEARING CAPABILITY AND METHOD COMPRISING SAME

(76) Inventor: Steve Eugene Everett, 1619 Wheless La., Austin, TX (US) 78723

( * ) Notice: Subject to any disclaimer, the term of this patent is extended or adjusted under 35 U.S.C. 154(b) by 554 days.

(21) Appl. No.: 11/643,207

(22) Filed: Dec. 21, 2006

(65) Prior Publication Data

US 2007/0113510 A1 May 24, 2007

Related U.S. Application Data

(63) Continuation-in-part of application No. 11/257,939, filed on Oct. 25, 2005, now Pat. No. 7,472,520.

(51) Int. Cl.
*E04B 1/02* (2006.01)

(52) U.S. Cl. ..... 52/561; 52/568; 52/564

(58) Field of Classification Search ..... 52/604, 52/592.1, 592.6, 503, 564, 574, 424, 561, 52/568; 446/124, 125

See application file for complete search history.

(56) References Cited

U.S. PATENT DOCUMENTS 1,226,214 A * 5/1917 Hopkins ..... 52/426
1,581,574 A * 4/1926 Heath et al. ..... 52/100
2,138,015 A * 11/1938 Barnhart ..... 52/310
2,371,201 A * 3/1945 Wells ..... 52/505
2,641,921 A * 6/1953 Lacy ..... 52/568
4,028,860 A * 6/1977 Hope et al. ..... 52/565
4,597,236 A * 7/1986 Braxton ..... 52/564
5,490,366 A * 2/1996 Burns et al. ..... 52/713
5,802,797 A * 9/1998 Storer-Folt ..... 52/604
6,668,505 B1 * 12/2003 Hohmann et al. ..... 52/565
2002/0001509 A1 * 1/2002 Hong ..... 405/286
2004/0074192 A1 * 4/2004 Mason ..... 52/604

* cited by examiner

*Primary Examiner*—Basil Katcheves
*Assistant Examiner*—Joshua Ihezie
(74) *Attorney, Agent, or Firm*—David O. Simmons

(57) ABSTRACT

A building block arrangement comprises a first layer of building blocks and a second layer of building blocks. The first layer of building blocks includes two spaced apart rows of building blocks whereby a space is provided between adjacent side faces of the building blocks of the first layer. The second layer of building blocks includes two spaced apart rows of building blocks whereby a space is provided between adjacent side faces of the building blocks of the second layer. The space includes communicative horizontal and vertical portions such that that the space at least partially isolates an interior wall portion from an exterior wall portion. The second layer of building blocks is positioned on top of the first layer of building blocks. The second layer of building blocks spans across at least a portion of the space in the first layer of building blocks.

8 Claims, 18 Drawing Sheets

STRUCTURAL BUILDING BLOCK SYSTEM WITH ENHANCED LOAD BEARING CAPABILITY AND METHOD COMPRISING SAME

CROSS REFERENCE TO RELATED APPLICATIONS

This patent application is a Continuation-In-Part patent application to United States Utility Patent Application having Ser. No. 11/257,939 filed Oct. 25, 2005, now U.S. Pat. 7,472,520 entitled "Structural Building Block System And Method Comprising Same", having a common applicant herewith and being incorporated herein in its entirety by reference.

FIELD OF THE DISCLOSURE

The disclosures made herein relate generally to building blocks configured for use in constructing residential, industrial and commercial structures and, more particularly, to building block systems configured for building such structures.

BACKGROUND

The practice of building structures such as, for example, homes from structural building blocks is well known. Examples of such structural building blocks include stone blocks, cinder blocks and Adobe blocks. Generally speaking, such structural building blocks are relatively strong, are relatively inexpensive to make and install, provide excellent thermal mass and offer a high yield rate in production and construction. Accordingly, these attributes make structural building blocks a preferred building material in many construction applications.

In fact, there are two factors that have contributed to the growing use of structural building blocks for constructing walls in buildings and homes. The first factor is that the cost of wood building materials has increased dramatically due to their decreasing availability. Wood building materials such as, for example, wood wall studs have become less available and, accordingly, more expensive. Additionally, in many instances, this decreasing availability has lead to a corresponding decrease in overall quality of such wood building materials. For example, straightness of wood wall studs has decreased as their availability has decreased. The second factor contributing to the growing use of structural building blocks is that structural building blocks generally are capable of providing better protection in severe weather than is wood building materials. For example, in a hurricane, a home having walls constructed from structural building blocks will typically offer a higher degree of protection from high wind speeds than would a wood studs.

Because of the mass and volume of typical structural building blocks, they provide for a relatively large thermal mass attributes. However, one limitation of structural building blocks is that they provide less than desirable and/or suitable insulating attributes. This limited thermal insulation often results in the need to add an insulation layer to the building block structure for applications where the interior space of a building structure is climate controlled (e.g., a house) with the expectation of maintaining a comfortable interior environment. In some cases, forming a double wall provides the insulation layer and the air space between the two walls (i.e., spaced apart walls) of the double wall serves as the insulating layer. In other cases, some form of insulating material is placed in the air space between the two walls of the double wall or on an interior or exterior face of a structural building block wall.

Two shortcoming of the practice of building double walls from structural building blocks are the difficulty in maintaining relatively uniform spacing between the two walls and maintaining structural integrity between the two walls. It is desirable for the space between a double wall to be relatively uniform and of a specified width such that aesthetic and architectural attributes (e.g., visual appearance and architectural dimensions) are maintained to a suitable degree of accuracy. Similarly, it is desirable for multiple layers of a double wall to be suitably interlocked to provide for structural rigidity. Conventional structural building blocks are limited in their ability to create uniform spaces between spaced apart walls and to uniformly connect multiple layers of the double wall. For example, it is common for double walls built from structural building blocks to be joined only at the upper-most layer via a masonry bond beam, which leaves the remainder of the two walls unsupported from lateral movement.

Therefore, a structural building blocks system and associated arrangement configured for building walls in a manner that overcomes drawbacks associated with conventional approaches for building walls using structural building blocks would be useful, advantageous and novel.

SUMMARY OF THE DISCLOSURE

Embodiments of the present invention advantageously overcome one or more shortcomings associated with conventional approaches for building wall structures using structural building blocks. More specifically, embodiments of structural building blocks in accordance with the present invention include integral means for creating uniform spaces within the wall structures (i.e., uniformly and consistently spaced apart building blocks), for uniformly interconnecting multiple layers of the wall structures, for providing one or more bearing members within the wall structures and for providing a load distribution structure that enables applied loading to be uniformly applied to the one or more load bearing members and, optionally, to the building blocks of the wall structure. Additionally, structural building blocks in accordance with the present invention offer traditional desirable attributes of structural building blocks such as being relatively strong, being relatively inexpensive to make and install, providing excellent thermal mass, and offering a relatively high yield rate in production and construction.

In one embodiment of the present invention, a building block arrangement comprises layers of building blocks. Each one of the layers includes a row of building blocks of a first configuration in end-to-end alignment and a row of building blocks of a second configuration in end-to-end alignment. The row of building blocks of the first configuration is spaced apart from the row of building blocks of the second configuration whereby a vertical wall isolation space extends between the rows of blocks of each one of the layers. The row of building blocks of the second configuration of each layer of building blocks laterally overlaps the vertical wall isolation space of each adjacent layer of building blocks and the row of building blocks of the first configuration of each adjacent layer of building blocks. The building blocks of the second configuration each include a stepped portion in an upper face thereof and/or a lower face thereof. The stepped portion of each one of the building blocks of the second configuration forms a horizontal wall isolation space extending between the vertical wall isolation space of adjacent layers of building blocks. A Vertical end passage channel is provided in each end face of the building blocks of the second configuration whereby the end-to-end alignment of the building blocks of the second configuration results in vertical end passage channels of adjacent building blocks of the second configuration forming a vertical end face passage extending therebetween.

In another embodiment of the present invention, a building block system comprises building blocks of a first configuration and building blocks of a second configuration. The building blocks of the first configuration each include an interlock structure provided at an upper face thereof and provided at a lower face thereof. The building blocks of the second configuration each include at least two spaced apart interlock structures provided at an upper face thereof and at a lower face thereof. The interlock structure provided at the upper face of the building blocks of the first configuration and the interlock structure provided at the lower face of the building blocks of the first configuration are each configured, respectively, for being interlockably engaged with each one of the interlock structures provided at the lower face of the building blocks of the second configuration and for being interlockably engaged with each one of the interlock structures provided at the upper face of the building blocks of the second configuration. Each one of the building blocks of the second configuration includes a stepped portion in the upper face thereof and/or the lower face thereof extending at least partially between opposing side faces thereof. Each one of the building blocks of the second configuration includes a vertical end passage channel in each end face thereof.

In another embodiment of the present invention, a method comprises forming a plurality of layers of building blocks, providing a first load bearing member extending through vertical end face passages of the plurality of layers and engaging a load distribution structure with the first load bearing member. Each one of the layers includes a row of building blocks of a first configuration in end-to-end alignment and a row of building blocks of a second configuration in end-to-end alignment spaced apart from the row of building blocks of the first configuration whereby a vertical wall isolation space extends between the rows of blocks of each one of the layers. The row of building blocks of the second configuration of each layer of building blocks laterally overlaps the vertical wall isolation space of each adjacent layer of building blocks and the row of building blocks of the first configuration of each adjacent layer of building blocks. The building blocks of the second configuration each include a stepped portion in at least one of an upper face and a lower face thereof whereby the stepped portion of each one of the building blocks of the second configuration forms a horizontal wall isolation space extending between the vertical wall isolation space of adjacent layers of building blocks. A vertical end passage channel is provided in each end face of the building blocks of the second configuration whereby the end-to-end alignment of the building blocks of the second configuration results in vertical end passage channels of adjacent building blocks of the second configuration forming a vertical end face passage extending therebetween. At least a portion of the vertical end face passages of one of the layers is vertically aligned with a corresponding one of the vertical end face passages of each adjacent one of the layers. The first load bearing member has a first end portion adjacent a lowermost one of the layers of building blocks and a second end portion adjacent an uppermost one of the layers of building blocks. The load distributing structure is engaged with the second end portion of the first load bearing member.

These and other objects, embodiments advantages and/or distinctions of the present invention will become readily apparent upon further review of the following specification, associated drawings and appended claims.

DETAILED DESCRIPTION OF THE DRAWING FIGURES

Figure 1:
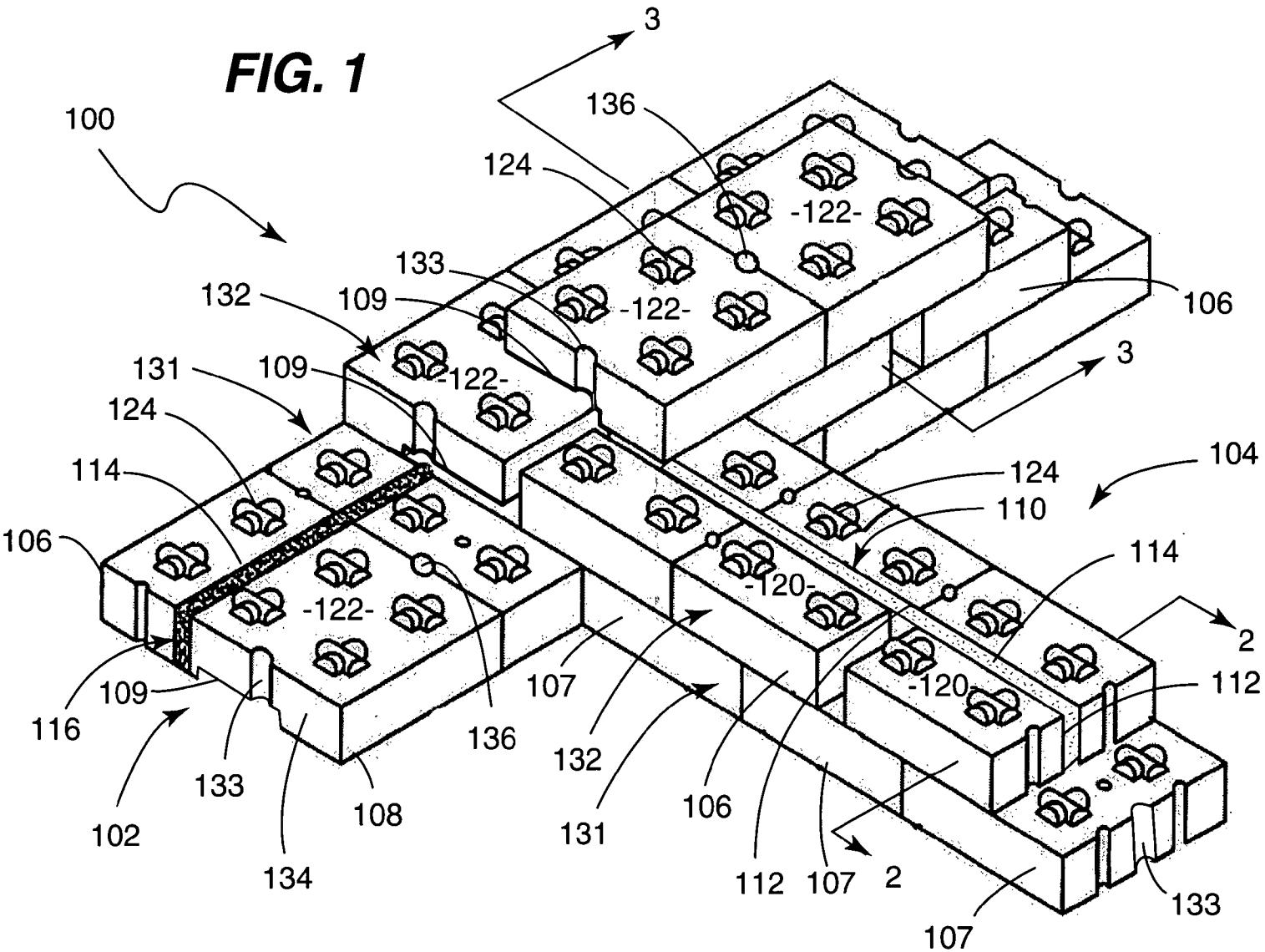
FIG. 1 depicts a first embodiment of a wall structure in accordance with the present invention.

FIG. 1 depicts an embodiment of a building block arrangement configured for constructing residential, industrial and commercial structures in accordance with the present invention, which is generally referred to herein as the building block arrangement 100. The building block arrangement 100 includes an exterior wall 102 and an interior wall 104. The interior wall 104 includes alternating layers of single-engagement building blocks 106 and non-stepped multiple-engagement building blocks 107. The exterior wall 102 includes layers having spaced apart rows of the single-engagement building blocks 106 and the stepped multiple-engagement building blocks 108. The stepped multiple-engagement building blocks 108 include a stepped portion 109, whose functionality will be discussed in greater detail below.

As will be discussed in greater detail below, it is disclosed herein that the exterior wall 102 and the interior wall 104 may use one or more different configurations of single-engagement building blocks and multiple-engagement building blocks. However, in a broad interpretation the single-engagement building blocks 106 are an embodiment of a first configuration of building block in accordance with the present invention and the multiple-engagement building blocks (107, 108) are an embodiment of a second configuration building block in accordance with the present invention.

Each layer of single-engagement building blocks 106 of the interior wall 104 includes spaced apart rows of single-engagement building blocks 106. In this manner, an interior wall isolation space 110 is provided between adjacent side faces 112 of the single-engagement building blocks 106. Each layer of non-stepped multiple-engagement building blocks 107 of the interior wall 104 includes a single row of multiple-engagement building blocks 106. The non-stepped multiple-engagement building blocks 107 of the interior wall 104 laterally span the interior wall isolation space 110 of the adjacent layers of the interior wall 104. In doing so, structural integrity between the spaced apart rows of the single layer building blocks 106 is enhanced. A barrier material 114 such as, for example, segments of rigid insulation, expanding foam, granulised foam or the like is optionally disposed in the interior wall isolation space 110 for enhancing noise and/or thermal insulating properties of the interior wall 104.

The spaced apart rows of the single-engagement building blocks 106 and the stepped multiple-engagement building blocks 108 in the exterior wall 102 provide an exterior wall isolation space 116 between adjacent side face 112 of the single-engagement building blocks 106 and side face 118 of the stepped multiple-engagement building blocks 108. The stepped multiple-engagement building blocks 108 of each layer of the exterior wall 102 laterally span the exterior wall isolation space 116 of the adjacent layers of the exterior wall 102. In doing so, structural integrity between the spaced apart rows of the building blocks of the exterior wall 102 is enhanced. Barrier material 114 (e.g., segments of rigid insulation, expanding foam, granulised foam or the like) is preferably, but not necessarily, disposed in the exterior wall isolation space 116 for enhancing noise and/or thermal insulating properties of the exterior wall 102. To further enhance noise and/or thermal insulating properties of the exterior wall 102, it is disclosed herein that a layer of barrier material is provided either integrally (provided on an upper face and/or lower face of each non-stepped multiple-engagement building block 108) or discretely between mating faces of each stepped multiple-engagement building block 108 (i.e., a sheet of a barrier material).

Figure 2:
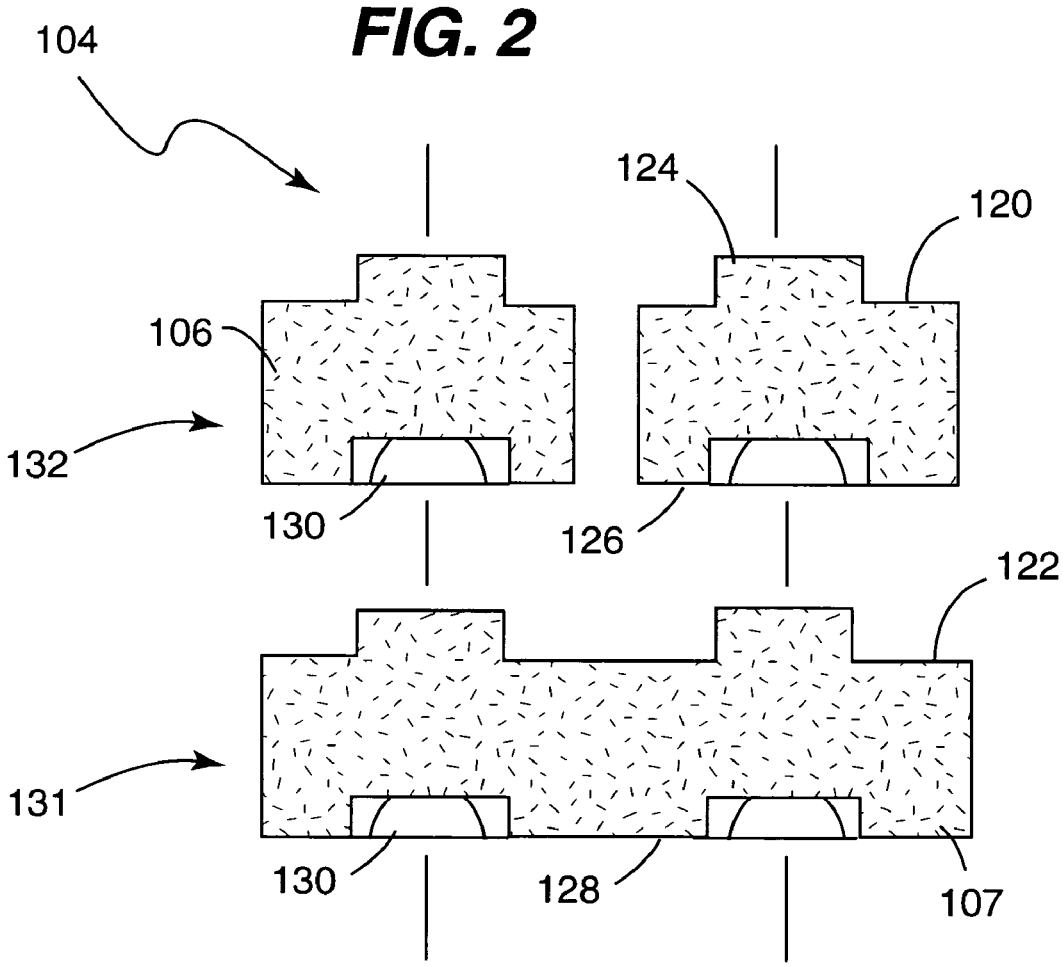
FIG. 2 is an expanded cross-sectional view taken along the line 2-2 in FIG. 1.

Referring now to FIGS. 1 and 2, an upper face 120 of each one of the single-engagement building blocks 106 and an upper face 122 of each one of the multiple-engagement building blocks (107, 108) include a first configuration of interlocking structure (i.e., the first configuration interlocking structure 124). A lower face 126 of each one of the single-engagement building blocks 106 and a lower face 128 of each one of the multiple-engagement building blocks (107, 108) include a second configuration of interlocking structure (i.e., the second configuration interlocking structure 130). Thus, at least a portion of the building blocks (106, 107, 108) of one layer of the exterior wall 102 and one layer of the interior wall 104 are interlockably engagable with the building blocks of one or more adjacent layers.

Mating interlocking structures of the single-engagement building blocks 106 and the multiple-engagement building blocks (107, 108) enable such interlocking engagement with the building blocks of one or more adjacent layers. Each face (120, 126) of the single-engagement building blocks 106 include a single set of interlocking structures, thus enabling each single-engagement building block 106 to form a single row of building blocks within a wall (i.e., a single-engagement building block). Each face (122, 128) of the multiple-engagement building blocks 106 include two sets of interlocking structures (i.e., a plurality of interlocking structures), thus enabling each multiple-engagement building block (107, 108) to engage multiple rows of adjacent building blocks within a wall (i.e., a multiple-engagement building block). Through such interlocking engagement, the first configuration interlocking structure 124 and the second configuration interlocking structure 130 jointly locate respective engaged building blocks laterally and longitudinally. Furthermore, the interlocking engagement provided by the interlocking structures (124, 130) serves to maintain a relatively uniform spacing between the two spaced apart rows of building blocks and maintaining structural integrity between such spaced apart rows.

It is disclosed herein that an interlocking structure preferably, but not necessarily, locates building blocks laterally and longitudinally. For example, in other embodiments of the present invention, the interlocking structure comprises an elongated channel that engages a mating interlocking member (e.g., a longitudinal ridge, discrete protruding features, etc) for facilitating constrained lateral locating and at least partially user selectable longitudinal locating.

With respect to the exterior wall 102, a first set of upper face interlocking structures of each stepped multiple-engagement building block 108 of a first layer 131 is engaged with a first set of lower face interlocking structures of a corresponding stepped multiple-engagement building block 108 of a second layer 132. Similarly, the upper face interlocking structures of each single-engagement building block 106 of the first layer 131 is engaged with a second set of lower face interlocking structures of the corresponding stepped multiple-engagement building block 108. In this fashion, adjacent layers of the exterior wall 102 are interlocked, spaced apart building blocks of each layer are uniformly interlocked and spaced apart rows are uniformly spaced apart from each other. With respect to the interior wall 104, a first set and second set of upper face interlocking structures of each stepped multiple-engagement building block 108 of the first layer 131 is engaged with the lower face interlocking structures of corresponding spaced apart single-engagement building blocks 106 of the second layer 132. In this fashion, adjacent layers of the interior wall 104 are interlocked, spaced apart building blocks of each layer are uniformly interlocked and spaced apart rows are uniformly spaced apart from each other.

Still referring to FIGS. 1 and 2, the first configuration interlocking structure 124 consists of a cross-shaped protrusion and the second configuration interlocking structure 130 consists of a cross-shaped recess configured for receiving the cross-shaped protrusion. Thus, rotation of the building blocks (106, 108) is limited to 90-degree increments while still permitting interlocking engagement. It is disclosed herein that other embodiments of the first configuration interlocking structure 124 and the second configuration interlocking structure 130 (e.g., cylindrical-shaped protrusions and recesses), which provide lateral and longitudinal locating functionality, are contemplated. Additionally, it is disclosed herein that still other embodiments of the first configuration interlocking structure 124 and the second configuration interlocking structure 130 may provide for lateral locating functionality only (i.e., building block position is longitudinally unrestrained).

It is disclosed herein that interlocking structures in accordance with the present invention may be fully or partially shearable. In such embodiments of the present invention, sufficient lateral movement causes at least a portion of the interlocking structure to shear, thereby allowing lateral and/or longitudinal displacement of adjacent layers of building blocks. The interlocking structures may be configured to be asymmetrically shearable such that they shear to enable the building blocks to displace in a desired direction (i.e., longitudinally more than laterally) of displacement in a desired Such shearing functionality is particularly useful and valuable in environments where soil is prone to shift and where earthquakes are probable.

Figure 3:
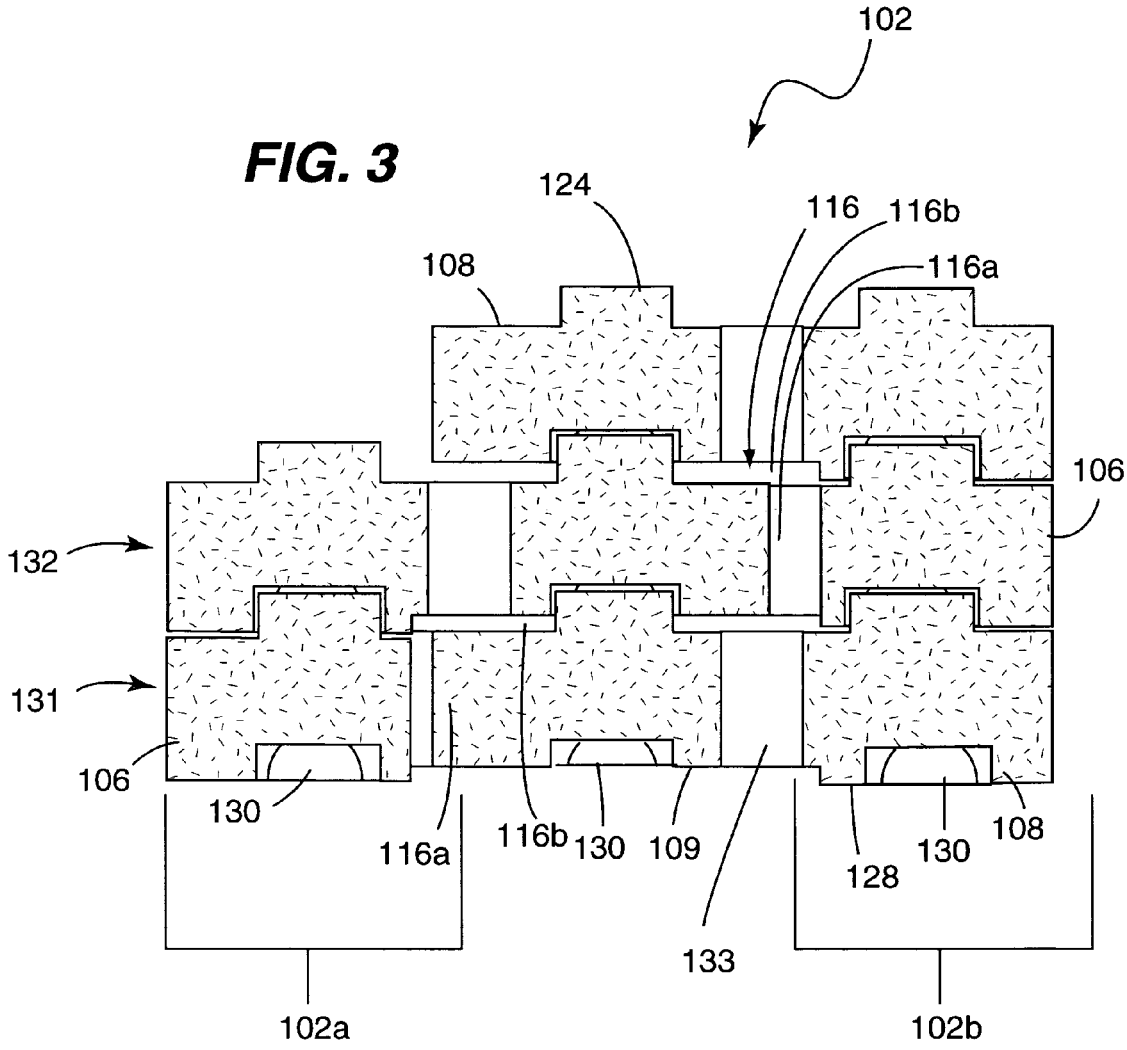
FIG. 3 is a cross-sectional view taken along the line 3-3 in FIG. 1.

As best depicted in FIG. 3, the exterior wall isolation space 116 includes a vertical portion 116*a* and a horizontal portion 116*b*. Each stepped multiple-engagement building blocks 108 used in the exterior wall 102 includes a stepped portion 109, which at least partially defines the horizontal portion 116*b* of the exterior wall isolation space 116. The exterior wall isolation space 116 serves to at least partially isolate (e.g., thermally and/or mechanically) an exterior wall portion 102*a* of the exterior wall 102 from an interior wall portion 102*b* of the exterior wall 102. In doing so, the rate of thermal transfer between the exterior wall portion 102*a* of the exterior wall 102 and the interior wall portion 102*b* of the exterior wall 102 is advantageously reduced relative to a wall without such isolation. It is disclosed herein that an insulating material besides air may be deposited within the vertical portion 116*a* and/or the horizontal portion 116*b* of the exterior wall isolation space 116. Examples of such insulating materials include but are not limited to foam-based insulation, fibreglass-based insulation, insulation-filled grout, insulation-filled mortar and the like.

The exterior wall portion 102*a* includes exterior exposed ones of the single-engagement building blocks 106 and adjacent portions the stepped multiple-engagement building blocks 108 above and below the exterior exposed ones of the single-engagement building blocks 106. The interior wall portion 102*b* includes interior exposed ones of the single-engagement building blocks 106 and adjacent portions the stepped multiple-engagement building blocks 108 above and below the interior exposed ones of the single-engagement building blocks 106.

Referring now to FIGS. 1 and 3, the stepped multiple-engagement building blocks 108 include an end face passage channel 133 in an end face 134 thereof. Each end face passage channel 133 is positioned such that end-to-end alignment of two of the stepped multiple-engagement building blocks 108 forms a vertically extending end face passage 136. The end face passage channel 133 of each one of the stepped multiple-engagement building blocks 108 and the space 110 of the interior wall 104 and the vertical portion 116*a* of the exterior wall isolation space 116 are each positioned such that the vertically extending end face passage 136 formed by two adjacent end face passage channels 133 is positioned at least partially in-line with the corresponding space (110, 116) of the respective wall (102, 104). Accordingly, the vertically-extending end face passage 136 and the corresponding space (110, 116) of the respective wall (102, 104) enable one or more articles to be disposed vertically and/or horizontally within the respective wall (102, 104). For example, wires, pipes, electrical conduit, support members and the like may be disposed within one or more vertically-extending end face passages 136, the interior wall isolation space 110 and/or the exterior wall isolation space 116. While shown as semi-circular, it is disclosed herein that the end face passage channel 133 may be other shapes such as, for example, rectangular.

The first configuration interlocking structure 124 and the second configuration interlocking structure 130 are jointly configured such that engagement of the first configuration interlocking structure 124 and the second configuration interlocking structure 130 serves to structurally maintain the horizontal portion 116*b* within the stepped portion 109. For example, the height of the first configuration interlocking structure 124 and the depth of the second configuration interlocking structure 130 are such that their butted engagement maintains at least a minimum distance between a bottom face of each stepped multiple-engagement building blocks 108 and a top face of an adjacent engaged stepped multiple-engagement building blocks 108. In one optional configuration, various other types of stand-offs may be implement for maintaining at least a minimum distance between a bottom face of each stepped multiple-engagement building blocks 108 and a top face of an adjacent engaged stepped multiple-engagement building block 108 within the stepped portion 109. Examples of such stand-offs include, but are not limited to, raised protrusions (e.g., ridges) that do not provide interlocking functionality. Such raised protrusions may extend in any one of a longitudinal direction, lateral direction and skewed direction with respect to a longitudinal axis of an associated exterior wall. In another optional configuration, the standoffs and/or mating features of the stepped multiple-engagement building block 108 within the stepped portion 109 may be omitted and a discrete standoff item may be inserted between the bottom face of each stepped multiple-engagement building block 108 and a top face of an adjacent engaged stepped multiple-engagement building blocks 108 within the stepped portion 109 of each stepped multiple-engagement building block 108. For example, an application specific insert (e.g., a dowel, disk, cube, etc) that is inserted between two adjacent blocks at the stepped portion 109 may be used to provide standoff functionality. Furthermore, the stepped portion 109 may be formed in the top face of the stepped multiple-engagement building block 108 (i.e., the face depicted as including the protruding interlocking structure) as opposed to the bottom face (i.e., the face depicted as including the recessed interlocking structure). Although the recessed interlocking structure is depicted in FIG. 3 as being in the stepped portion 109, it is disclosed herein that the protruding interlocking structure may be attached to the stepped multiple-engagement building block 108 within the stepped portion 109.

Turning now to a discussion of building block systems, building blocks in accordance with the present invention are elements of a system of building blocks in accordance with the present invention. Such building blocks are configured for enabling walls in accordance with the present invention to be constructed in a manner that is predictable, efficient and consistent. As discussed above in reference to FIGS. 1-3, walls in accordance with the present invention include uniformly and consistently spaced apart building blocks that create a correspondingly uniform and consistent space between the building blocks and that have multiple layers that are uniformly interlocked.

Figure 4:
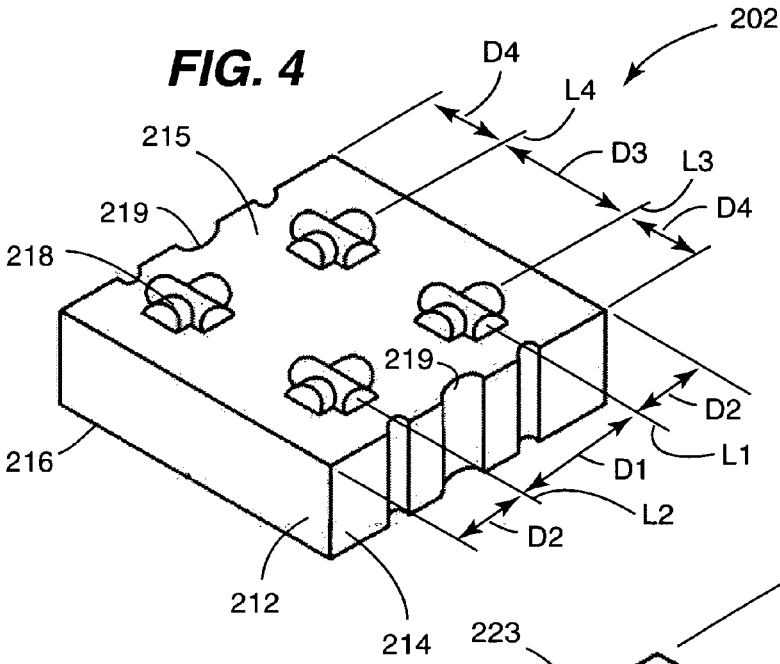
FIG. 4 depicts a first embodiment of a laterally and longitudinally symmetric multiple-engagement building block in accordance with the present invention.
Figure 5:
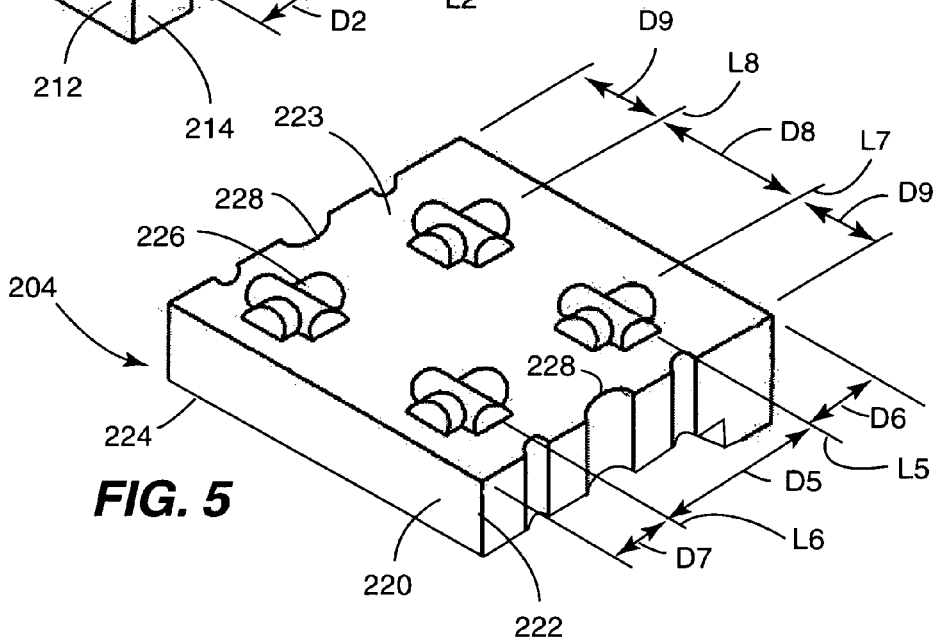
FIG. 5 depicts a first embodiment of an offset-side multiple engagement building block in accordance with the present invention.
Figure 7:
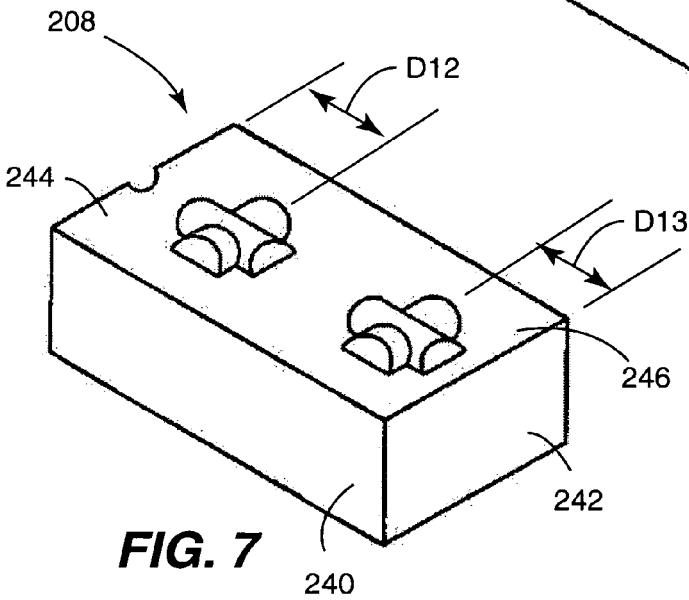
FIG. 7 depicts a first embodiment of a laterally and longitudinally asymmetric single-engagement building block in accordance with the present invention.
Figure 8:
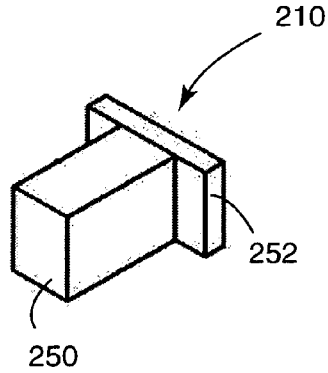
FIG. 8 depicts an embodiment of a nailing plug in accordance with the present invention.

In one embodiment, a system of building blocks in accordance with the present invention includes a standard multiple-engagement building block 202 (FIG. 4), an offset-side multiple-engagement building block 204 (FIG. 5), an offset-side single-engagement building block 206 (FIG. 6), an offset-end single-engagement building block 208 (FIG. 7) and a nailing plug 210 (FIG. 8). Preferably, but not necessarily, the offset-side multiple-engagement building block 204 has a stepped portion as depicted in reference to the stepped multiple-engagement building block 108 depicted in FIGS. 1 and 3. The various building blocks of the system are substantially the same height and are interconnectable such that a broad array of interior and exterior wall arrangements are capable of being constructed. Preferably and advantageously, the various building blocks of the system do not require any alteration for such broad array of wall arrangements to be constructed, which saves time and precludes structural compromises associated with user-configured building blocks. It is disclosed herein that the standard multiple-engagement building block 202 (FIG. 4) and the offset-side multiple-engagement building block 204 (FIG. 5) may each have a stepped configuration (e.g., similar to the stepped multiple-engagement building blocks 108 depicted in FIGS. 1 and 3) or may be non-stepped (i.e., as depicted in FIGS. 4 and 5).

Figure 9A:
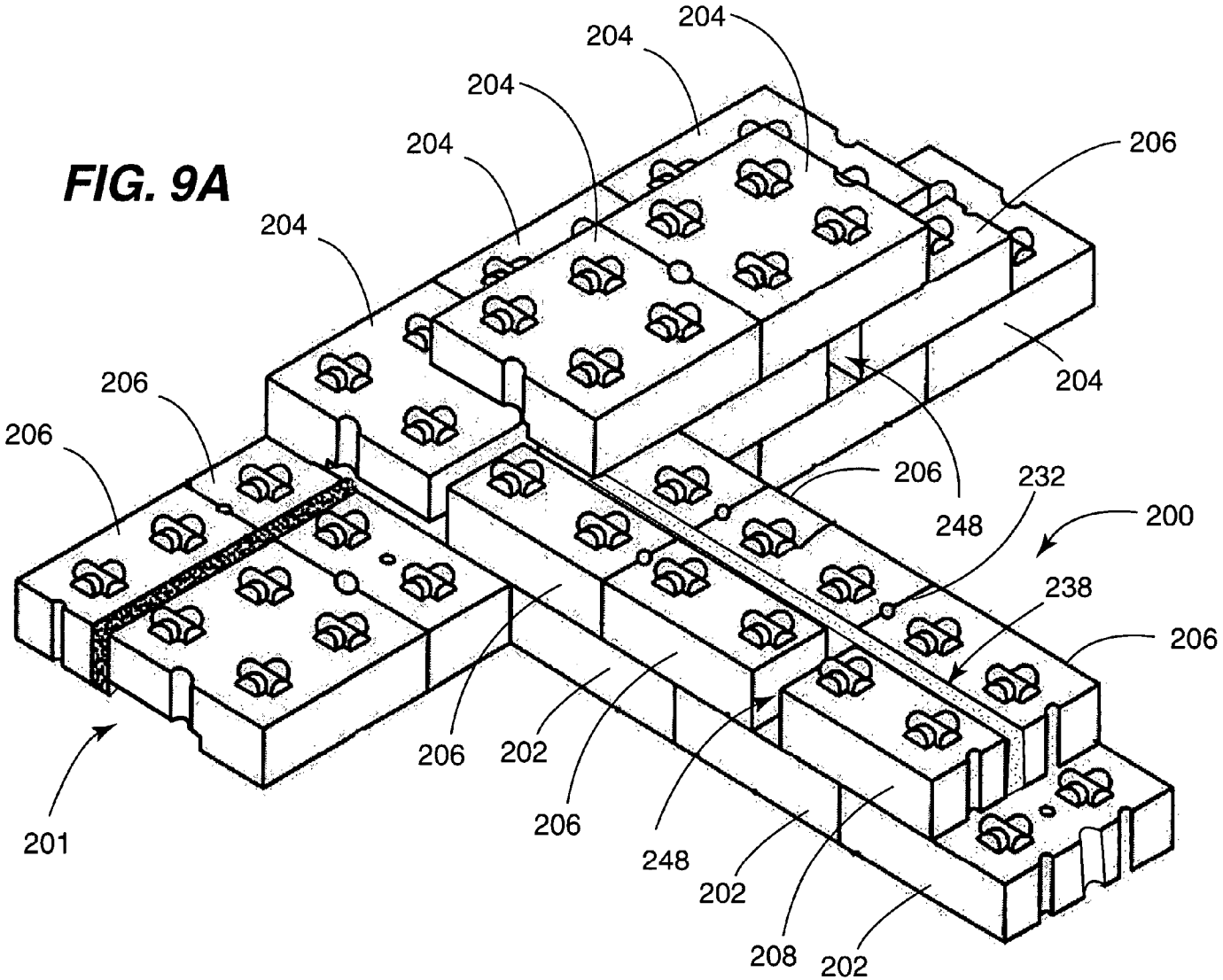
FIG. 9A depicts a first embodiment of a wall structure constructed using the building blocks of FIGS. 4-7, which is structurally the same as the wall structure of FIG. 1.

Typical use of the standard multiple-engagement building block 202 (FIG. 4) includes construction of every other layer of an interior wall 200 depicted in FIG. 9A. The standard multiple-engagement building block 202 is non-stepped and includes spaced apart side faces 212, spaced apart end faces 214 and spaced apart support faces (i.e., upper face 215 and lower face 216). Upper face interlocking structures 218 of the standard multiple-engagement building block 202 are aligned with corresponding lower face interlocking structures (not specifically shown) of the standard multiple-engagement building block 202. A longitudinal centerline L1 of a first set of the interlocking structures 218 is laterally spaced apart from a longitudinal centerline L2 of a second set of the interlocking structures 218 by a distance D1. Each side face 212 is offset from the longitudinal centerline (L1, L2) of the adjacent interlocking structures 218 by a distance D2. A lateral centerline L3 of a first interlocking structure of each set of interlocking structures 218 is longitudinally spaced apart from a lateral centerline L4 of a second set of the interlocking structures 218 by a distance D3. Each end face 214 is offset from the lateral centerline (L3, L4) of the adjacent interlocking structures 218 by a distance D4. Thus, the standard multiple-engagement building block 202 is laterally and longitudinally symmetric. End faces 214 of the standard multiple-engagement building block 202 each include an end face passage channel 219.

Typical use of the offset-side multiple-engagement building block 204 (FIG. 5) includes construction of rows within the each layer of an exterior wall 201 depicted in FIG. 9A. The offset-side multiple-engagement building block 202 includes spaced apart side faces 220, spaced apart end faces 222 and spaced apart support faces (i.e., upper face 223 and lower face 224). The overall length of the offset-side multiple-engagement building block 204 is substantially the same as that of the standard multiple-engagement building block 202. Upper face interlocking structures 226 of the offset-side multiple-engagement building block 204 are aligned with corresponding lower face interlocking structures (not specifically shown) of the offset-side multiple-engagement building block 204.

A longitudinal centerline L5 of a first set of the interlocking structures 218 is laterally spaced apart from a longitudinal centerline L6 of a second set of the interlocking structures 218 by a distance D5. A first one of the side faces 220 is offset from the longitudinal centerline L5 by a first distance D6, which is substantially the same as the distance D2 of the standard multiple-engagement building block 202. A second one of the side faces 220 is offset from the longitudinal centerline L6 by a second distance D7, which is less than the first distance D6. A lateral centerline L7 of a first interlocking structure of each set of interlocking structures 226 is longitudinally spaced apart from a lateral centerline L8 of a second interlocking structure of each set of the interlocking structures 226 by a distance D8, which is substantially the same as the distance D3 of the standard multiple-engagement building block 202. Each end face 222 is offset from the lateral centerline (L7, L8) of the adjacent interlocking structures 226 by a distance D9, which is substantially the same as the distance D4 of the standard multiple-engagement building block 202. Thus, the offset-face multiple-engagement building block 204 is laterally asymmetric and longitudinally symmetric. End faces 222 of the offset-side multiple-engagement building block 204 each include an end face passage channel 228.

Typical uses of the offset-side single-engagement building block 206 (FIG. 6) include construction of alternating layers of the interior wall 200 and construction of rows within each layer of the exterior wall 201 (FIG. 9A). The offset-side single-engagement building block 206 includes spaced apart side faces 230, spaced apart end faces 232 and spaced apart support faces 234 (i.e., upper and lower faces). The overall length of the offset-side single-engagement building block 206 is substantially the same as that of the standard multiple-engagement building block 202. Upper face interlocking structures 236 of the offset-side single-engagement building block 206 are aligned with corresponding lower face interlocking structures (not specifically shown) of the offset-side single-engagement building block 206. The longitudinal spacing and relative longitudinal position of the interlocking structures 236 of the offset-side single-engagement building block 206 is substantially the same as that of the standard multiple-engagement building block 202, thereby enabling interconnection therebetween.

A first one of the side faces 230 is offset from a longitudinal centerline L9 of the interlocking structures 236 by a first distance D10. A second one of the side faces 230 is offset from the longitudinal centerline L9 of the interlocking structures 236 by a second distance D11, which is less than the first distance D10. Thus, the offset-side single-engagement building block 206 is laterally asymmetric (i.e., spaced apart side faces that are substantially non-equidistant from a longitudinal centerline of the interlock structures).

Longitudinally, the offset-side single-engagement building block 206 is substantially the same dimensionally as is the standard multiple-engagement building block 202 and the offset-side multiple-engagement building block 204. As depicted in FIG. 9, end faces 232 of two offset-side single-engagement building block 206 effectively abut each other when the two offset-side single-engagement building block 206 are engaged with the same interlocking structure 218 of a face of the standard multiple-engagement building block 202. Additionally, as depicted in FIG. 9A, inboard positioning of the second one of the side faces 220 (i.e., offset position side face 220) of the offset-side single-engagement building block 206 provides for creation of an interior wall isolation space 238 and a generally flush exterior surface.

Typical use of the offset-end single-engagement building block 208 (FIG. 7) includes construction of alternating layers of the interior wall 200 and construction of rows within each layer of the exterior wall 201 (FIG. 9A). Laterally, the offset-end single-engagement building block 208 is identical to the offset-side single-engagement building block 206 depicted in FIG. 6 (i.e., is laterally asymmetric). The offset-end single-engagement building block 208 includes spaced apart side faces 240, spaced apart end faces 242 and spaced apart support faces 244 (i.e., upper and lower faces). Upper face interlocking structures 246 of the offset-end single-engagement building block 208 are aligned with corresponding lower face interlocking structures (not specifically shown) of the offset-end single-engagement building block 208. The longitudinal spacing and relative longitudinal position of the interlocking structures 246 of the offset-end single-engagement building block 208 is substantially the same as that of the standard multiple-engagement building block 202, thereby enabling interconnection therebetween. A first one of the end faces 242 (i.e., standard position end face) is longitudinally offset from an adjacent interlocking structure 246 by a first distance D12. A second one of the end faces 242 (i.e., offset position end face 242) is longitudinally offset from an adjacent interlocking structure 246 by a second distance D13, which is less than the first distance D12. Thus, the offset-end single-engagement building block 208 is longitudinally asymmetric (i.e., spaced apart end faces that are substantially non-equidistant from adjacent ones of the interlock structures 246) and laterally asymmetric (i.e., spaced apart side faces that are substantially non-equidistant from a longitudinal centerline of the interlock structures)

Use of an offset-end single-engagement building block 208 in the interior wall 200 or the exterior wall 201 results in an exposed gap 248. The nailing plug 210, which is made from a material that a nail or screw can be suitably driven into, is configured for being disposed within the exposed gap 248. For example, the nailing plug 210 includes a first portion 250 sized for fitting within the exposed gap 248 and a second portion 252 sized for fitting in the interior wall isolation space 238. Optionally, the offset-end single-engagement building block 208 is configured such that the exposed gap 248 receives a standard size electrical box.

It is disclosed herein that the system of building blocks may include two versions of the offset-end single-engagement building block 208, which have offset end faces at the opposite end thereof. In this manner, the adjacent use of two such offset-end single-engagement building block 208 results in the exposed gap 248 being twice as wide as when the offset end of the offset-end single-engagement building block 208 is adjacent the standard position end of the offset-side single row building block 206.

Figure 6:
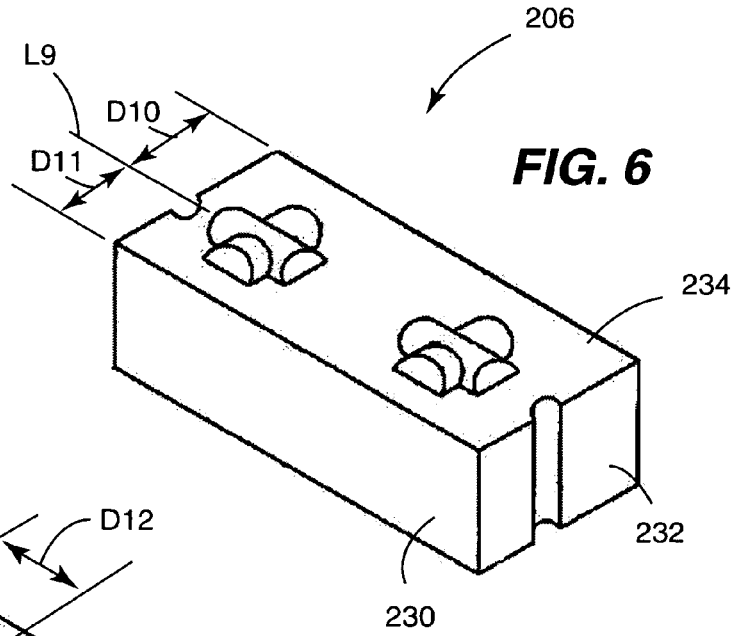
FIG. 6 depicts a first embodiment of an offset-side single-engagement building block in accordance with the present invention.
Figure 9B:
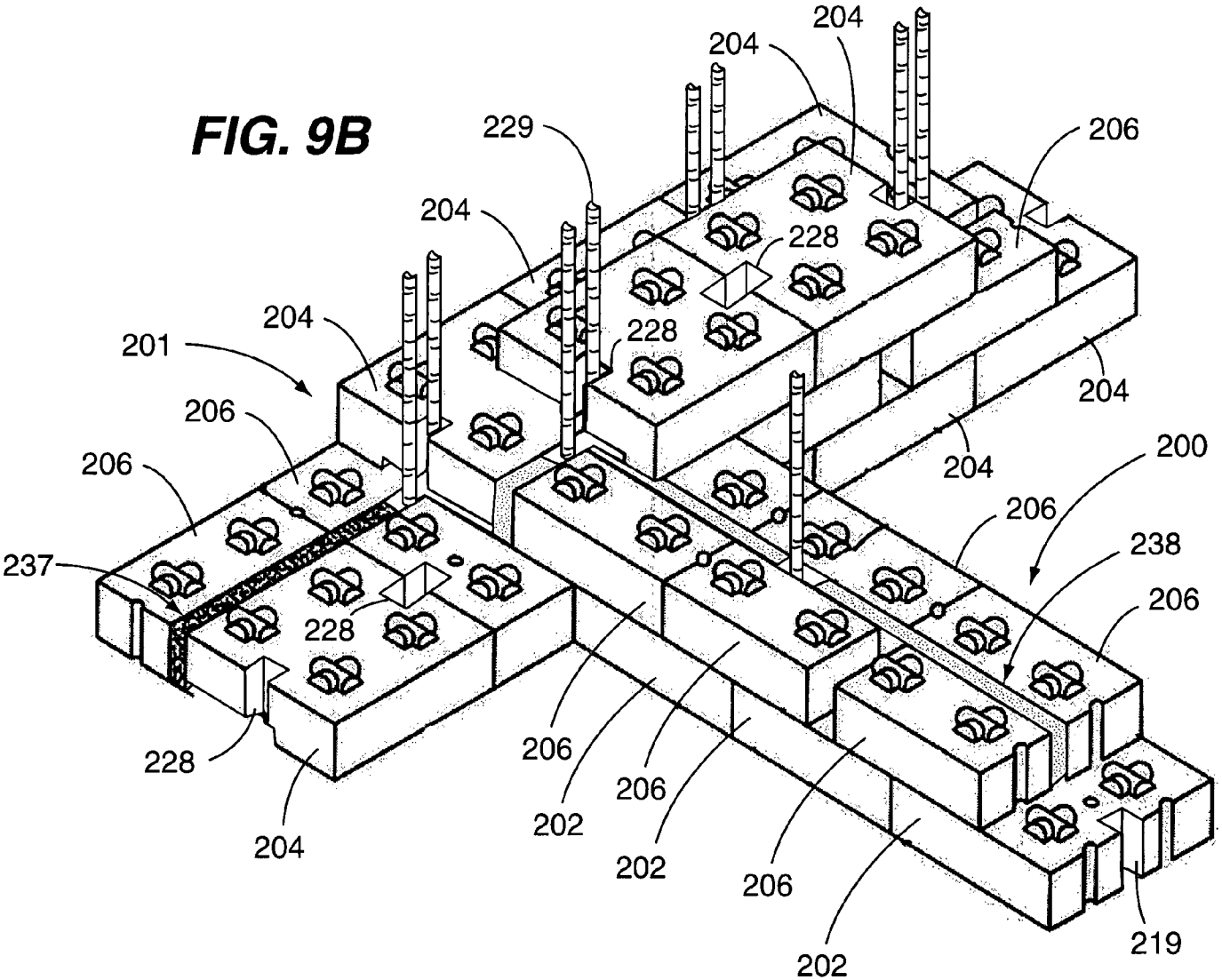
FIG. 9B depicts a second embodiment of a wall structure constructed using slightly modified versions of the building blocks of FIGS. 4-7.

It is disclosed herein that the building blocks FIGS. 4-7 can be used for forming exterior and interior walls (200, 201) what have load bearing members provided herein. In one embodiment, as shown in FIG. 9B, standard multiple-engagement building block 202, the offset-side multiple-engagement building block 204 shown in FIG. 5 and the offset-side single-engagement building block 206 shown in FIG. 6 are used for forming such walls. The passage channels 228 of the offset-side multiple-engagement building block 204 are rectangular shaped whereby the load bearing members have a rectangular cross sectional shape. In the exterior wall 201, the load bearing members extend vertically through vertical passages between adjacent offset-side multiple-engagement building block 204 and the exterior wall isolation space 237. In the exterior wall 201, the load bearing members extend vertically through vertical passages formed by the passage channels 228 of adjacent offset-side multiple-engagement building block 204 and through the exterior wall isolation space 237 between spaced apart rows of building blocks (204, 206). In the interior wall 200, the load bearing members extend vertically through vertical passages formed by the passage channels 219 of adjacent standard multiple-engagement building block 204 and through the interior wall isolation space 238 between spaced apart rows of offset-side single-engagement building block 206. In one embodiment (shown in FIG. 9B), the load bearing members are poured-in-place masonry beams having structural reinforcing members 229 surrounded by a flowable masonry material (e.g., concrete or mortar). To control the flow of the flowable masonry material, a block-off material 231 is placed at selective locations. The flowable masonry material can be deposited as each layer is being constructed or flowed into place after all or a portion of the walls have been constructed. In another embodiment (not shown), the load bearing members are preformed (e.g., wood studs) around which the building blocks (204, 206) are placed.

As will be appreciated from the inventive disclosures made herein, one aspect of the present invention is creation of a space between spaced apart rows of building blocks. Discussed above are means configured for accomplishing such a space through the use of offset faces of building blocks. It is disclosed herein that such a space can be created through the use of laterally symmetric building blocks. Thus, the present invention is not limited to building blocks with offset side faces. For example, a multiple-engagement building block having a distance between spaced apart interlocking structures (e.g., 13 inches) that is substantially more than twice the width of a mating laterally symmetric single-engagement building block (i.e., 6 inches) would result in a space (e.g., 1-inch wide space) between spaced apart rows of the mating laterally symmetric single-engagement building block interlockably engaged with such an extended-width multiple-engagement building block.

Figure 12:
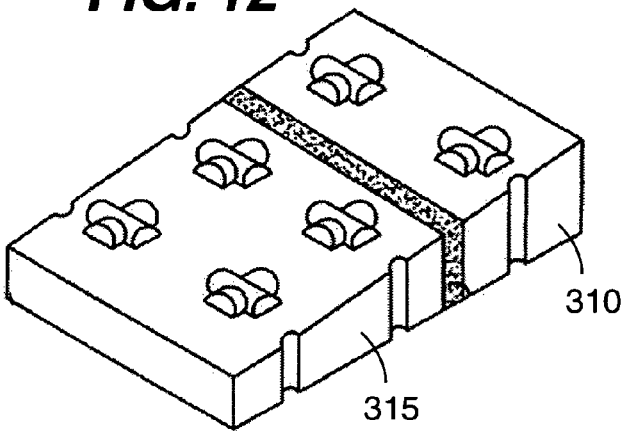
FIGS. 10-12 depict an embodiment of a system of tapered thickness building blocks in accordance with the present invention, which are configured for enabling construction of an arch.
Figure 11:
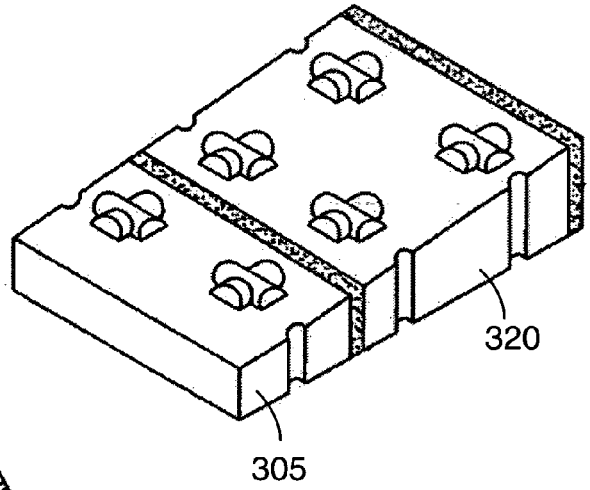
Figure 10:
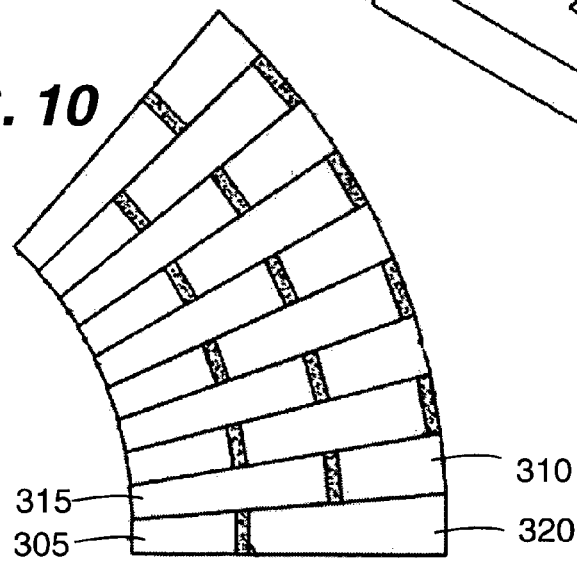

It is disclosed herein that the present invention is not limited to creation of planar walls. The structure of the present invention that enables interlocking functionality and the structure of the present invention that enables creation of interior wall isolation spaces may be applied to non-rectangular blocks. For example, a system of tapered thickness building blocks as depicted in FIGS. 10-12 are configured for producing an arch. The system of tapered thickness building blocks includes an inner single-engagement building block 305, an outer single-engagement building block 310, an inner multiple-engagement building block 315 and an outer multiple-engagement building block 320. The tapered thickness building blocks (305-320) of the system each includes interlocking structure substantially as described above in reference to FIGS. 1-9.

Similarly, a system of tapered thickness building blocks having a wedge-shape profile in the plan view provides for fabrication of domes in accordance with the present invention. However, such blocks for a dome require that each layer of building blocks be configured for providing a smaller diameter circle, as required for creating a generally spherical shape. Another distinction of a system of building blocks configured for fabricating a dome is that interlocking structures of the building blocks preferably locates adjacent blocks radially in a fully constrained manner, but not fully laterally constrained. A ridge and a mating channel on upper and lower faces of such building blocks, respectively, is an example of an interlocking structure useful with such system of building blocks specifically configured for fabricating domes. In this manner, spacing between adjacent building blocks may be adjusted at least a prescribed amount.

Figure 14:
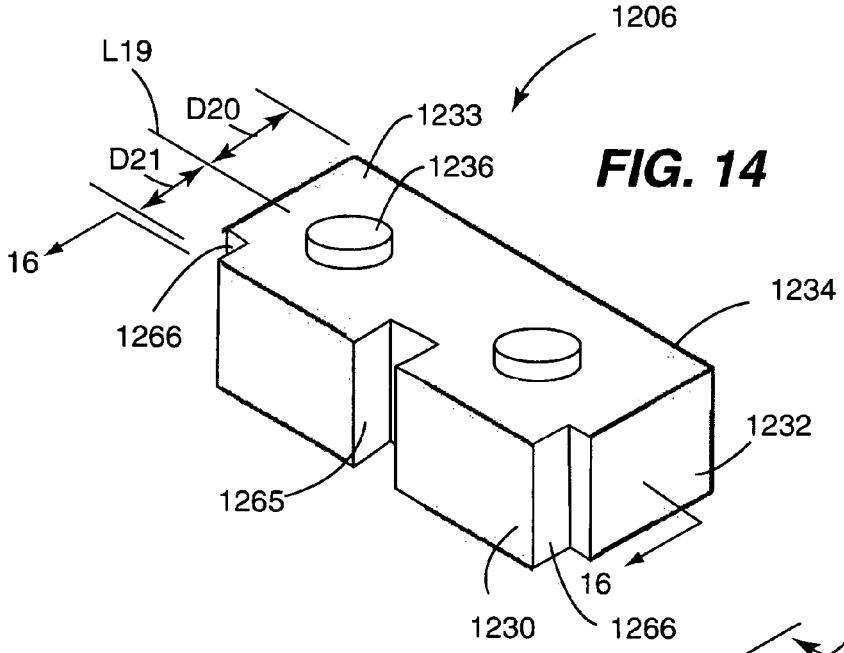
FIG. 14 depicts a second embodiment of an offset-side single-engagement building block in accordance with the present invention.
Figure 13:
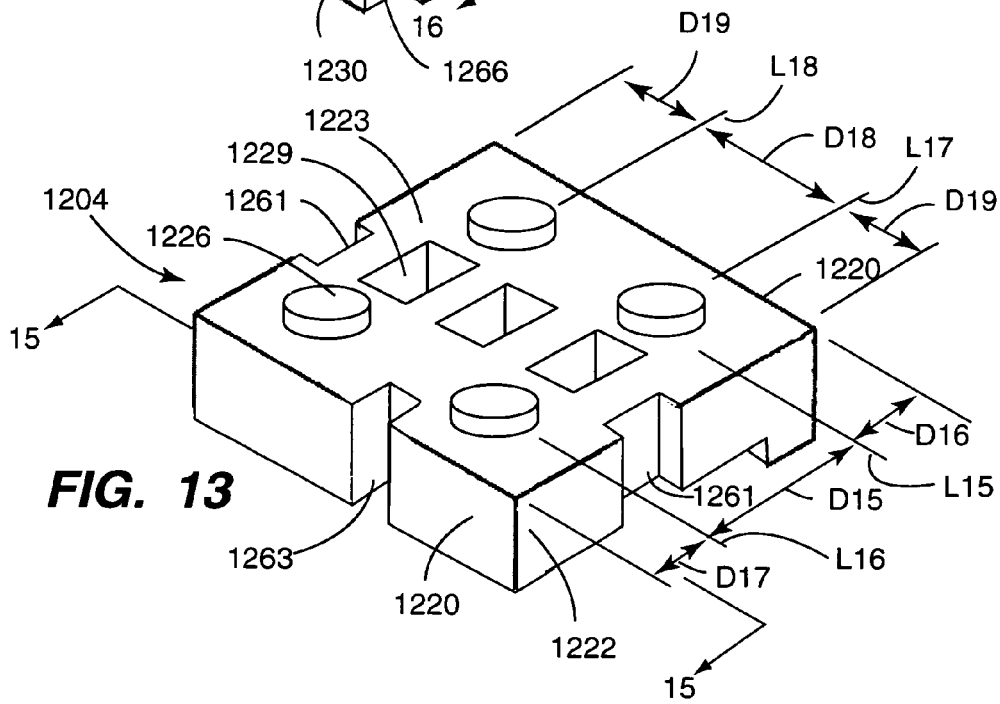
FIG. 13 depicts a second embodiment of an offset-side multiple engagement building block in accordance with the present invention.
Figure 15:
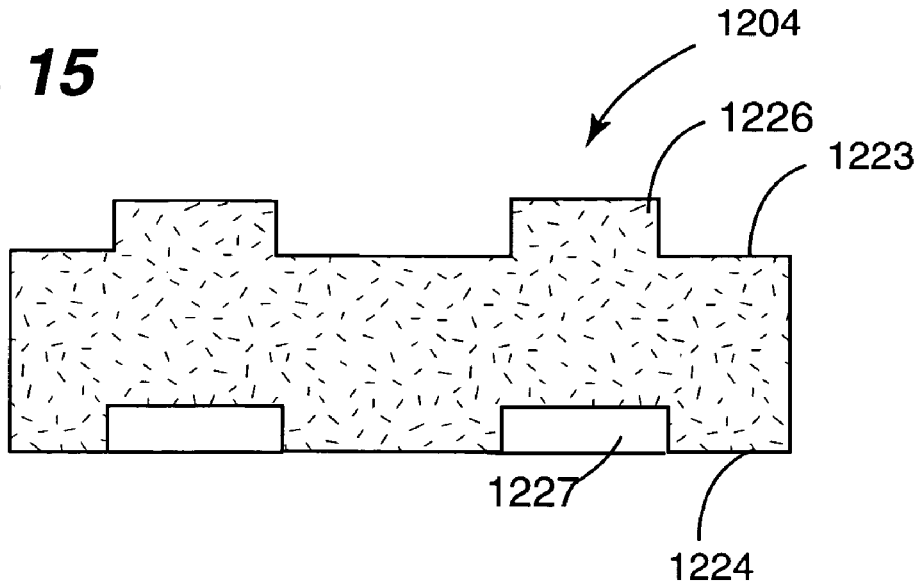
FIG. 15 is a cross-sectional view taken along the line 15-15 in FIG. 13.
Figure 16:
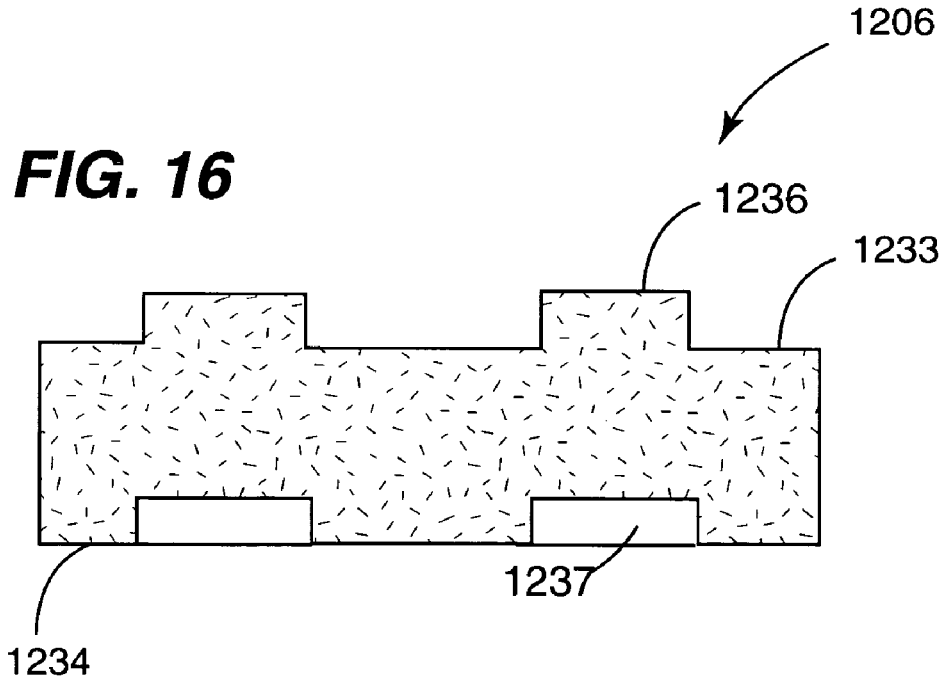
FIG. 16 is a cross-sectional view taken along the line 16-16 in FIG. 14.

Referring now to FIGS. 13-16, building blocks configured for constructing a first embodiment of a load-sharing wall structure in accordance with the present invention are shown. An offset-side multiple-engagement building block 1204 is shown in FIG. 13 and an offset-side single-engagement building block 1206 is shown in FIG. 14. The offset-side multiple-engagement building block 1204 preferably, but not necessarily, has a stepped portion 1209 that is substantially identical to the stepped portion 109 disclosed above in reference to FIG. 1. The stepped portion 1209 enables a wall isolation space to be provided that is similar to the exterior wall isolation space 116 shown above in FIG. 1. The offset-side multiple-engagement building block 1204 and the offset-side single-engagement building block 1206 have substantially the same overall height and are interconnectable such that a broad array of wall arrangements are capable of being constructed.

The offset-side multiple-engagement building block 1204 (FIGS. 13 and 15) includes spaced apart side faces 1220, spaced apart end faces 1222 and spaced apart support faces (i.e., upper 1223 and lower face 1224). Upper face interlocking structures 1226 (FIGS. 13 and 15) of the offset-side multiple-engagement building block 1204 are aligned with corresponding lower face interlocking structures 1227 (FIG. 15) of the offset-side multiple-engagement building block 1204. As depicted, the upper face interlocking structures 1226 of the offset-side multiple-engagement building block 1204 are protruding features and the lower face interlocking structures 1227 of the offset-side multiple-engagement building block 1204 are recessed features. Alternatively, the upper face interlocking structures 1226 of the offset-side multiple-engagement building block 1204 may be recessed features and the lower face interlocking structures 1227 of the offset-side multiple-engagement building block 1204 may be protruding features.

The offset-side single-engagement building block 1206 (FIGS. 14 and 16) includes spaced apart side faces 1230, spaced apart end faces 1232 and spaced apart support faces 1234 (i.e., upper and lower faces). The overall length of the offset-side single-engagement building block 1206 is substantially the same as that of the offset-side multiple-engagement building block 1204. Upper face interlocking structures 1236 (FIGS. 15 and 16) of the offset-side single-engagement building block 1206 are aligned with corresponding lower face interlocking structures 1237 (FIG. 16) of the offset-side single-engagement building block 1206. The longitudinal spacing and relative longitudinal position of the interlocking structures (1236, 1237) of the offset-side single-engagement building block 1206 are substantially the same as the interlock structures (1226, 1227) of the offset multiple-engagement building block 1204, thereby enabling uniform spacing and interconnection therebetween. As depicted, the upper face interlocking structures 1236 of the offset-side single-engagement building block 1206 are protruding features and the lower face interlocking structures 1227 of the offset-side single-engagement building block 1206 are recessed features. Alternatively, the upper face interlocking structures 1226 of the offset-side single-engagement building block 1206 may be recessed features and the lower face interlocking structures 1227 of the offset-side single-engagement building block 1206 may be protruding features.

The offset configuration of the offset-side multiple-engagement building block 1204 (FIG. 13) is essentially the same as the offset configuration of the offset-side multiple-engagement building block 204 discussed above in reference to FIG. 5. More specifically, a longitudinal centerline L15 of a first set of the interlocking structures (1226, 1227) of the offset-side multiple-engagement building block 1204 is laterally spaced apart from a longitudinal centerline L16 of a second set of the interlocking structures (1226, 1227) of the offset-side multiple-engagement building block 1204 by a distance D15. A first one of the side faces 1220 of the offset-side multiple-engagement building block 1204 is offset from the longitudinal centerline L15 by a first distance D16. A second one of the side faces 1220 of the offset-side multiple-engagement building block 1204 is offset from the longitudinal centerline L16 by a second distance D17, which is less than the first distance D16. A lateral centerline L17 of a first interlocking structure of each set of interlocking structures 1226 is longitudinally spaced apart from a lateral centerline L18 of a second interlocking structure of each set of the interlocking structures (1226, 1227) by a distance D18. Each end face 1222 is offset from the lateral centerline (L17, L18) of the adjacent interlocking structures 1226 by a distance D19. Thus, the offset-face multiple-engagement building block 1204 is laterally asymmetric and longitudinally symmetric.

As shown in FIG. 13, central passages 1229 extend between the upper and lower faces of the offset-side multiple-engagement building block 1204. As shown, central passages 1229 are positioned between adjacent sets of interlocking structures (1226, 1227). Preferably, but not necessarily, one central 1229 is positioned approximately equidistant between the end faces of the building block 1204. Three central passages 1229 are shown. However, building blocks in accordance with the present invention may include more than three central passages 1229 or less than three central passages 1229. Examples of uses for the one or more central passages 1229 include, but are not limited to, circulation of air or other flowable matter, routing of structural elements (e.g., load bearing members), routing of utilities and the like.

The offset configuration of the offset-side single-engagement building block 1206 (FIG. 14) is essentially the same as the offset configuration of the offset-side single-engagement building block 206 discussed above in reference to FIG. 6. More specifically, a first one of the side faces 1230 is offset from a longitudinal centerline L19 of the interlocking structures (1236, 1237) by a first distance D20. A second one of the side faces 1230 is offset from the longitudinal centerline L19 of the interlocking structures 1236 by a second distance D21, which is less than the first distance D20. Longitudinally, the offset-side single-engagement building block 1206 is substantially the same dimensionally as is the offset-side multiple-engagement building block 1204. Thus, the offset-side single-engagement building block 1206 is laterally asymmetric (i.e., spaced apart side faces that are substantially non-equidistant from a longitudinal centerline of the interlock structures) and longitudinally symmetric.

Referring now to FIGS. 13-18, a wall structure 1251 (FIGS. 17 and 18) constructed using the offset-side multiple-engagement building block 1204 (FIG. 13) and the offset-side single-engagement building block 1206 (FIG. 14) is discussed. The offset-side multiple-engagement building block 1204 and the offset-side single-engagement building block 1206 in adjacent layers of the wall structure 1251 are interconnected in an alternating and overlapping manner, as shown. Alternating refers to the lateral positioning of offset-side multiple-engagement building blocks 1204 and offset-side single-engagement building blocks 1206 being in a first orientation in a particular layer of the wall structure 1251 (i.e., offset-side multiple-engagement building blocks 1204 defining a first side face of the wall structure 1251 and offset-side single-engagement building block 1206 defining a second side face of the wall structure 1251) and being in the opposite orientation in immediately adjacent layers (i.e., offset-side multiple-engagement building blocks 1204 defining the second side face of the wall structure 1251 and offset-side single-engagement building block 1206 defining the first side face of the wall structure 1251). Overlapping refers to bocks in one layer being longitudinally displaced by one half of their width (e.g., one row of interlocking structures) in immediately adjacent rows of the wall structure 1251. Accordingly, this alternating and overlapping arrangement in combination with the offset face of each offset-side multiple-engagement building block 1204 and each offset-side single-engagement building block 1206 and the stepped portion 1209 of the offset-side multiple-engagement building block 1204 results in each layer of the wall structure 1251 including a wall isolation space 1216 includes vertical portions 1216*a* and horizontal portions 1216*b*. The stepped portion 1209 of each offset-side multiple-engagement building block 1204 at least partially defines the horizontal portions 1216*b* of the wall isolation space 1216.

The wall isolation space 1216 serves to at least partially isolate (e.g., thermally and/or mechanically) an exterior wall portion 1202*a* of the wall structure 1251 from an interior wall portion 1202*b* of the wall structure 1251. In doing so, the rate of thermal transfer between the exterior wall portion 1202*a* of the wall structure 1251 and the interior wall portion 1202*b* of the wall structure 1251 is advantageously reduced relative to a wall without such isolation of the wall portions. It is disclosed herein that an insulating material besides air may be deposited within all or a portion of the vertical portions 1216*a* and/or the horizontal portions 1216*b* of the wall isolation space 1216. Examples of such insulating materials include but are not limited to foam-based insulation, fibreglass-based insulation, insulation-filled grout, insulation-filled mortar and the like.

Still referring to FIGS. 13-18, each offset-side multiple-engagement building block 1204 includes end face passage channels 1261 and a side face passage channel 1263. An end face passage channel 1261 is provided in the end face 1222 of each offset-side multiple-engagement building block 1204. The side face passage channel 1263 of each offset-side multiple-engagement building block 1204 is provided in the side face 1220 that defines the vertical portion 1216*a* of the wall isolation space 1216. Each offset-side single-engagement building block 1206 includes a side face passage channel 1265 and corner passage channels 1266. The passage channels (1265, 1266) of each offset-side single-engagement building block 1206 are provided in the side face 1230 that defines the vertical portion 1216*a* of the wall isolation space 1216.

Figure 17:
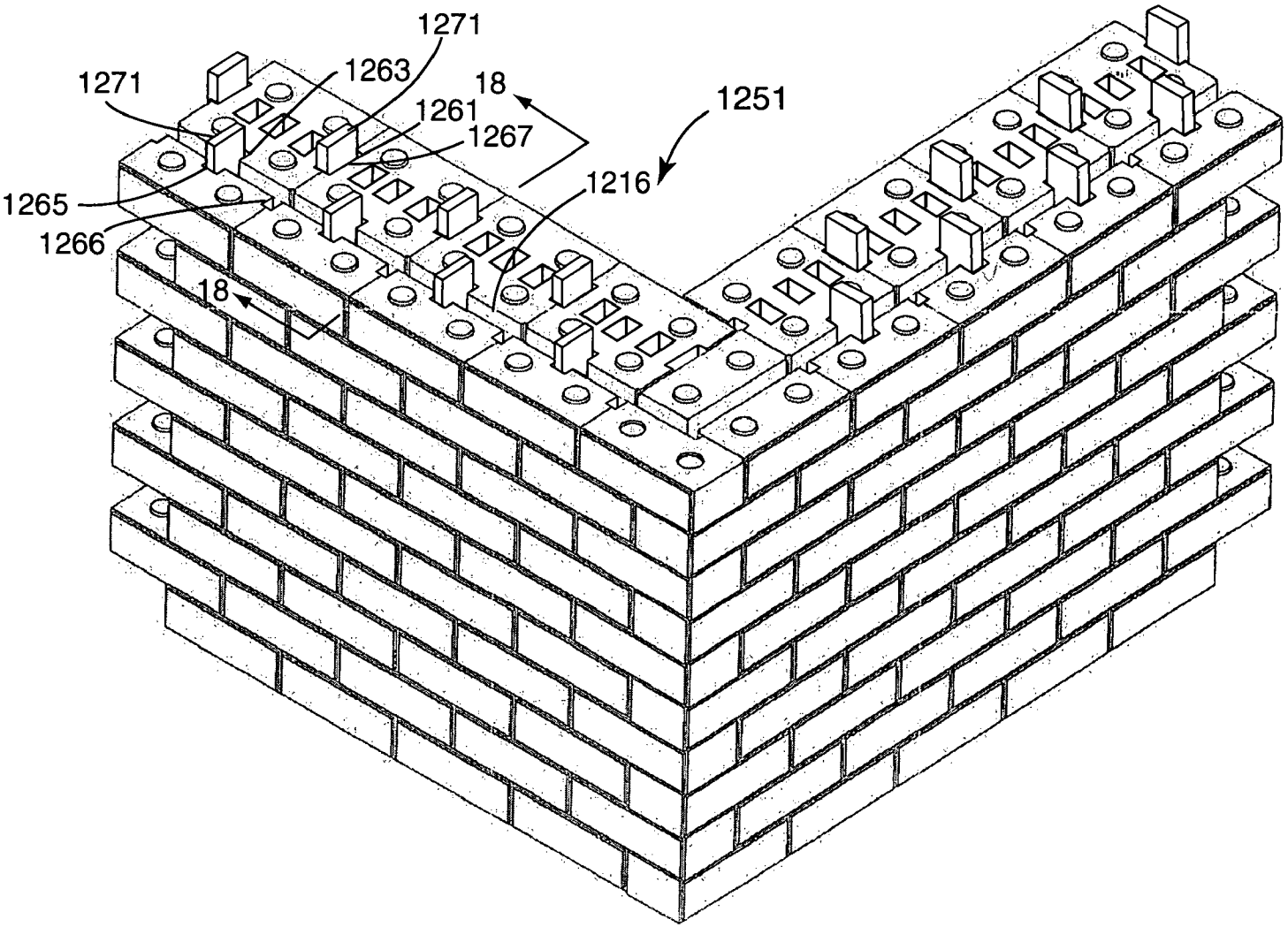
FIG. 17 depicts a second embodiment of a wall structure in accordance with the present invention, which is constructed using the building blocks of FIGS. 13 and 14.
Figure 18:
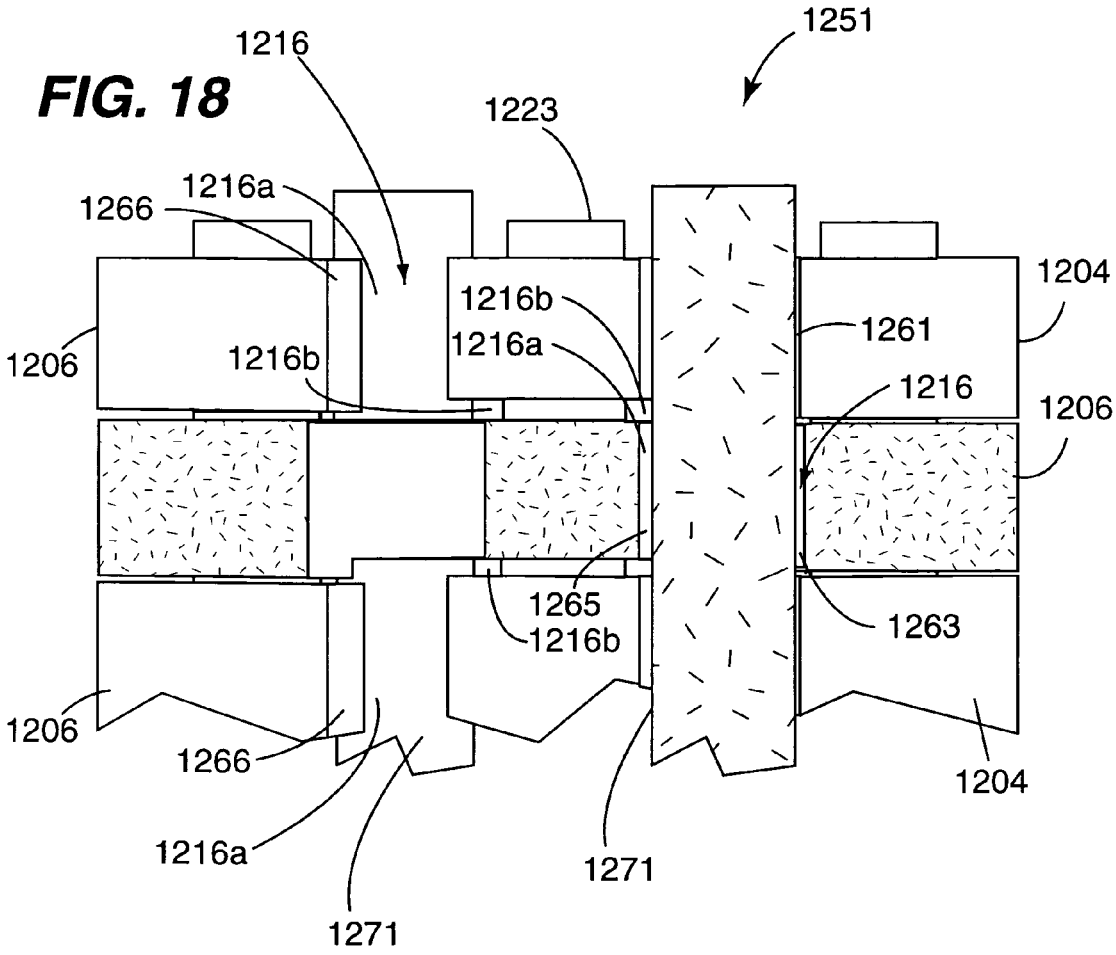
FIG. 18 is a cross-sectional view taken along the line 18-18 in FIG. 17.

Referring to FIGS. 17 and 18, the end face passage channels 1261 of each offset-side multiple-engagement building block 1204 are positioned such that end-to-end alignment of two offset-side multiple-engagement building blocks 1204 results in formation of a vertical end face passage 1267 extending between adjacent offset-side multiple-engagement building blocks 1204 within a layer of the wall structure 1251. The side face passage channels 1263 of each offset-side multiple-engagement building block 1204 and the side face passage channels 1265 of the adjacent offset-side single-engagement building block 1206 in a layer of the wall structure are laterally aligned with respect to the respective vertical portion 1216*a* of the wall isolation space 1216. The alternating and offset configuration of the wall structure 1251 (discussed above) causes each vertical end face passage 1267 in a particular layer of the wall structure 1251 to be vertically aligned with laterally-aligned side face passage channels (1263, 1265) of immediately adjacent layers of the wall structure 1251 and causes each pair of laterally-aligned side face passage channels (1263, 1265) in the particular layer of the wall structure 1251 to be vertically aligned with a vertical end face passage 1267 of immediately adjacent layers of the wall structure 1251.

As shown in FIGS. 17 and 18, such vertical alignment of the laterally-aligned side face passage channels (1263, 1265) and vertical end face passage 1267 enables a plurality of load bearing members 1271 to be vertically disposed within the wall structure 1251. The load bearing members 1271 extend through such vertically aligned end face passages 1267 and the side face passage channels (1263, 1265) from a footing or ground structure on which the wall structure 1251 is formed through a top portion of the wall structure 1251. The end face passages 1267 and the side face passage channels (1263, 1265) are vertically aligned in adjacent layers. In this manner, vertical loading from a roof structure or flooring structure, for example, can be supported by the load bearing members 1271 and, optionally, the building blocks (1204, 1206) of the wall structure 1251. Examples of each load bearing member 1271 include, but are not limited to, a wooden beam, a steel beam, steel reinforced concrete beam and the like.

Figure 19:
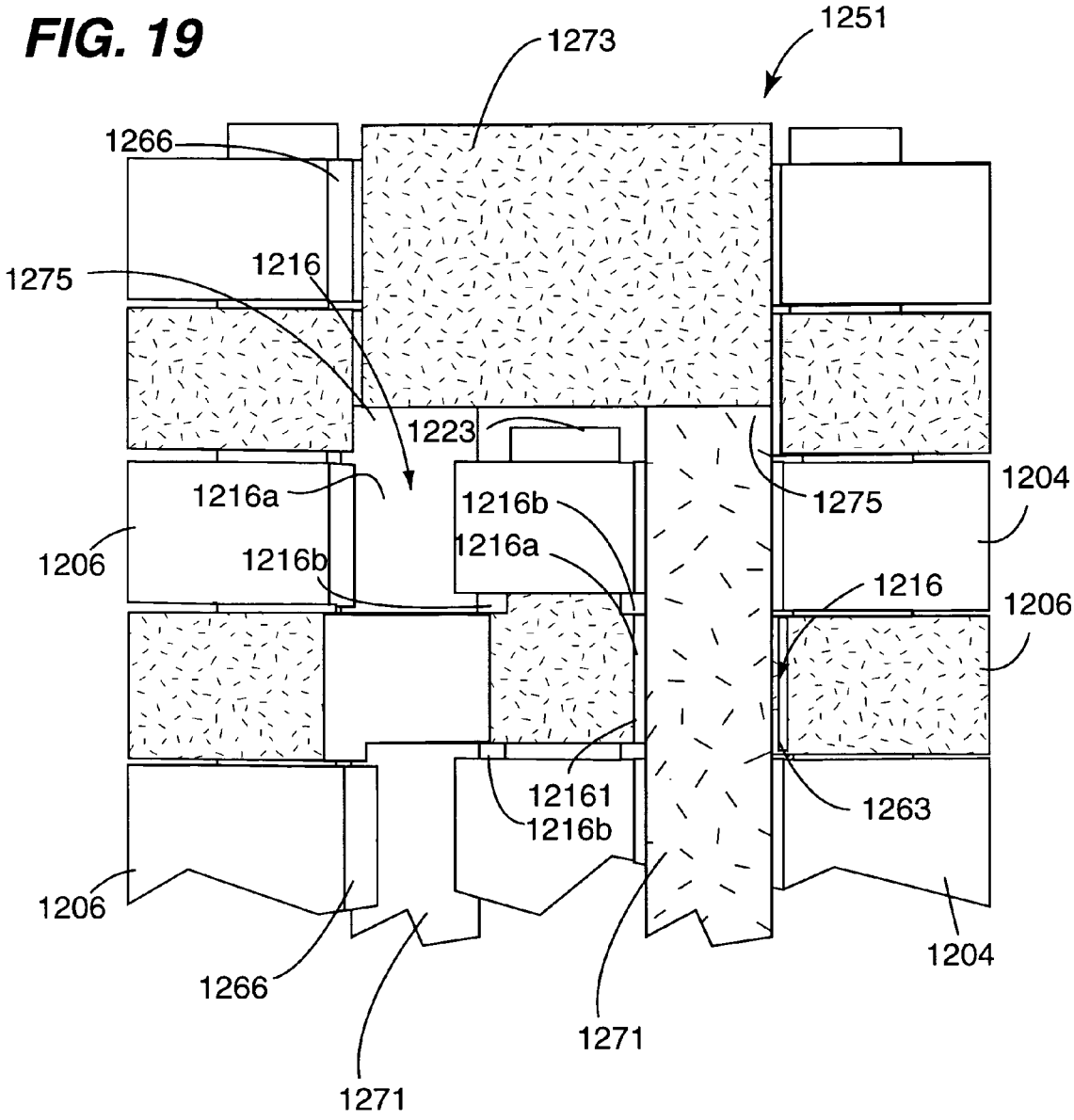
FIG. 19 is a cross-sectional showing the wall structure of FIG. 17 with a load distributing structure incorporated therewith.

Referring now to FIG. 19, a load distribution structure 1273 extends longitudinally along a top of the wall structure 1251. The load distribution structure 1273 is engaged with exposed upper end portions 1275 of the load bearing members 1271. Examples of the load distribution structure 1273 include, but are not limited to, a wooden beam, a steel beam, steel reinforced concrete beam and the like. Preferably, but not necessarily, the width and placement of the load distribution structure 1273 is such that a suitable number of offset-side single-engagement building blocks 1206 may be stacked adjacent to the load distribution structure 1273 for concealing and/or laterally supporting the load distribution structure 1273.

With reference to FIGS. 17-19, it is disclosed herein that placement of an offset-side single-engagement building blocks 1206 in a position that would otherwise be held by an offset-side multiple-engagement building blocks 1204 will utilize corner passage channels 1266. The corner passage channels 1266 of adjacent offset-side single-engagement building blocks 1206 that are in end-to-end alignment form a corner passage that provide clearance for load bearing members that would otherwise reside within an end face passage channel 1261 of respective offset-side multiple-engagement building blocks 1204. Thus, the corner passage channels 1266 allow for uniform aesthetic appearance of a wall structure (i.e., uniform pattern of a wall face).

It is disclosed herein that the offset-side multiple-engagement building block 1204 and the offset-side single-engagement building block 1206 discussed above in reference to FIGS. 13 and 14 can be used for forming an interior wall similar to that shown in FIG. 1. Such a wall formed using the building blocks (1204, 1206) of FIGS. 13 and 14 can have one of more load bearing members vertically routed through vertical passages of adjacent offset-side multiple-engagement building blocks 1204 in each respective layer and through side face passage channels of adjacent offset-side single-engagement building blocks 1206 in a respective layer. Furthermore, a flowable masonry material can be provided within all or a portion of the vertical wall space.

Figure 21:
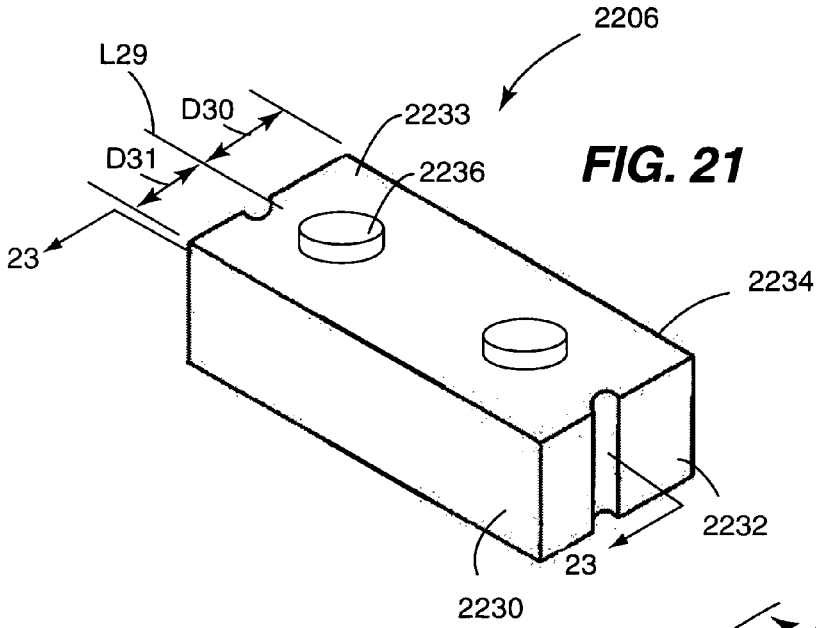
FIG. 21 depicts a third embodiment of an offset-side single-engagement building block in accordance with the present invention.
Figure 20:
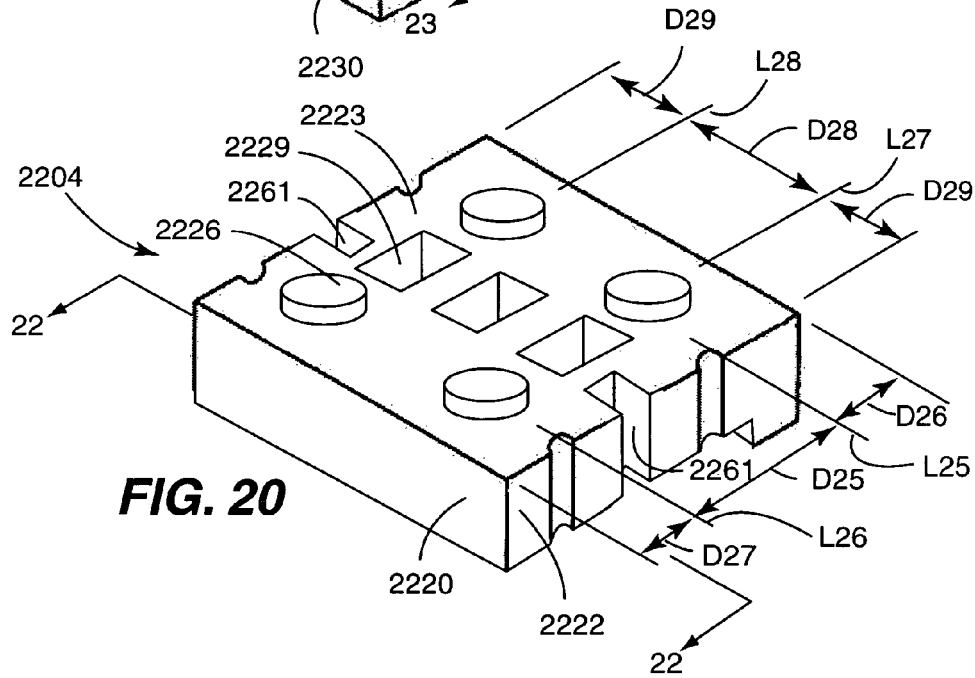
FIG. 20 depicts a third embodiment of an offset-side multiple engagement building block in accordance with the present invention.
Figure 22:
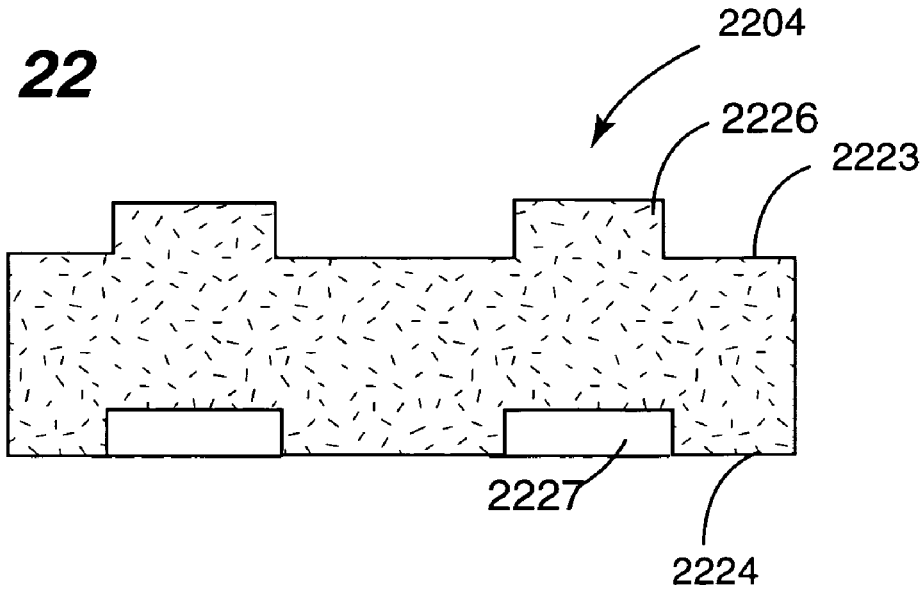
FIG. 22 is a cross-sectional view taken along the line 22-22 in FIG. 20.
Figure 23:
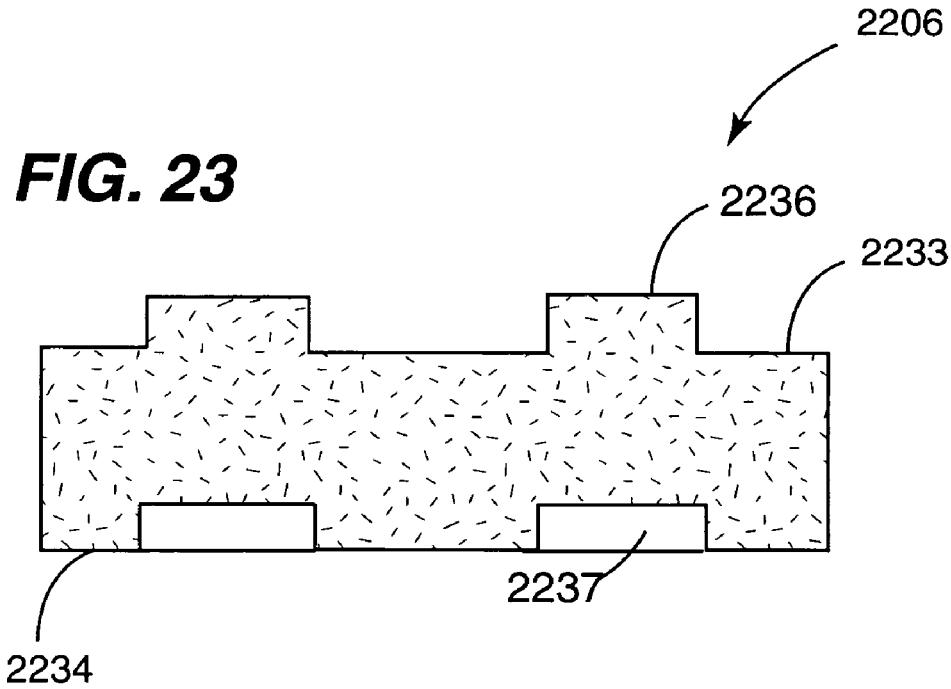
FIG. 23 is a cross-sectional view taken along the line 23-23 in FIG. 21.

Referring now to FIGS. 20-23, building blocks configured for constructing a second embodiment of a load-sharing wall structure in accordance with the present invention are shown. An offset-side multiple-engagement building block 2204 is shown in FIG. 20 and an offset-side single-engagement building block 2206 is shown in FIG. 21. The offset-side multiple-engagement building block 2204 preferably, but not necessarily, has a stepped portion 2209 that is substantially identical to the stepped portion 109 disclosed above in reference to FIG. 1. The stepped portion 2209 enables a wall isolation space to be provided that is similar to the exterior wall isolation space 116 shown above in FIG. 1. The offset-side multiple-engagement building block 2204 and the offset-side single-engagement building block 2206 have substantially the same overall height and are interconnectable such that a broad array of wall arrangements are capable of being constructed.

The offset-side multiple-engagement building block 2204 (FIGS. 20 and 22) includes spaced apart side faces 2220, spaced apart end faces 2222 and spaced apart support faces (i.e., upper face 2223 and lower face 2224). Upper face interlocking structures 2226 (FIGS. 20 and 22) of the offset-side multiple-engagement building block 2204 are aligned with corresponding lower face interlocking structures 2227 (FIG. 22) of the offset-side multiple-engagement building block 1204. As depicted, the upper face interlocking structures 2226 of the offset-side multiple-engagement building block 1204 are protruding features and the lower face interlocking structures 2227 of the offset-side multiple-engagement building block 2204 are recessed features. Alternatively, the upper face interlocking structures 2226 of the offset-side multiple-engagement building block 2204 may be recessed features and the lower face interlocking structures 2227 of the offset-side multiple-engagement building block 2204 may be protruding features.

The offset-side single-engagement building block 2206 (FIGS. 20 and 22) includes spaced apart side faces 2230, spaced apart end faces 2232 and spaced apart support faces 2234 (i.e., upper and lower faces). The overall length of the offset-side single-engagement building block 2206 is substantially the same as that of the offset-side multiple-engagement building block 2204. Upper face interlocking structures 2236 (FIGS. 21 and 23) of the offset-side single-engagement building block 2206 are aligned with corresponding lower face interlocking structures 2237 (FIG. 23) of the offset-side single-engagement building block 2206. The longitudinal spacing and relative longitudinal position of the interlocking structures (2236, 2237) of the offset-side single-engagement building block 2206 are substantially the same as the interlock structures (2226, 2227) of the offset multiple-engagement building block 2204, thereby enabling uniform spacing and interconnection therebetween. As depicted, the upper face interlocking structures 2236 of the offset-side single-engagement building block 1206 are protruding features and the lower face interlocking structures 2227 of the offset-side single-engagement building block 2206 are recessed features. Alternatively, the upper face interlocking structures 2226 of the offset-side single-engagement building block 2206 may be recessed features and the lower face interlocking structures 2227 of the offset-side single-engagement building block 1206 may be protruding features.

The offset configuration of the offset-side multiple-engagement building block 2204 (FIG. 20) is essentially the same as the offset configuration of the offset-side multiple-engagement building block 204 discussed above in reference to FIG. 5. More specifically, a longitudinal centerline L25 of a first set of the interlocking structures (2226, 2227) of the offset-side multiple-engagement building block 2204 is laterally spaced apart from a longitudinal centerline L26 of a second set of the interlocking structures (2226, 2227) of the offset-side multiple-engagement building block 2204 by a distance D25. A first one of the side faces 2220 of the offset-side multiple-engagement building block 2204 is offset from the longitudinal centerline L25 by a first distance D26. A second one of the side faces 2220 of the offset-side multiple-engagement building block 2204 is offset from the longitudinal centerline L26 by a second distance D27, which is less than the first distance D26. A lateral centerline L27 of a first interlocking structure of each set of interlocking structures 2226 is longitudinally spaced apart from a lateral centerline L28 of a second interlocking structure of each set of the interlocking structures (2226, 2227) by a distance D28. Each end face 2222 is offset from the lateral centerline (L27, L28) of the adjacent interlocking structures 2226 by a distance D29. Thus, the offset-face multiple-engagement building block 2204 is laterally asymmetric and longitudinally symmetric.

As shown in FIG. 20, central passages 2229 extend between the upper and lower faces of the offset-side multiple-engagement building block 2204. Preferably, but not necessarily, one central 2229 is positioned approximately equidistant between the end faces of the building block 2204. As shown, central passages 2229 are positioned between adjacent sets of interlocking structures (2226, 2227). Three central passages 2229 are shown. However, building blocks in accordance with the present invention may include more than three central passages 2229 or less than three central passages 2229. As is disclosed below, the central passages 2229 enable circulation of air through the central mass of the each offset-side multiple-engagement building block 2204.

The offset configuration of the offset-side single-engagement building block 2206 (FIG. 21) is essentially the same as the offset configuration of the offset-side single-engagement building block 206 discussed above in reference to FIG. 6. More specifically, a first one of the side faces 2230 is offset from a longitudinal centerline L29 of the interlocking structures (2236, 2237) by a first distance D30. A second one of the side faces 2230 is offset from the longitudinal centerline L29 of the interlocking structures 2236 by a second distance D31, which is less than the first distance D30. Longitudinally, the offset-side single-engagement building block 2206 is substantially the same dimensionally as is the offset-side multiple-engagement building block 2204. Thus, the offset-side single-engagement building block 2206 is laterally asymmetric (i.e., spaced apart side faces that are substantially non-equidistant from a longitudinal centerline of the interlock structures) and longitudinally symmetric.

Referring now to FIGS. 20-25, a wall structure 2251 (FIGS. 24 and 25) constructed using the offset-side multiple-engagement building block 2204 (FIG. 20) and the offset-side single-engagement building block 2206 (FIG. 21) is discussed. The offset-side multiple-engagement building block 2204 and the offset-side single-engagement building block 2206 in adjacent layers of the wall structure 1251 are interconnected in an alternating and overlapping manner, as shown. Alternating refers to the lateral positioning of offset-side multiple-engagement building blocks 2204 and offset-side single-engagement building blocks 2206 being in a first orientation in a particular layer of the wall structure 2251 (i.e., offset-side multiple-engagement building blocks 2204 defining a first side face of the wall structure 2251 and offset-side single-engagement building block 1206 defining a second side face of the wall structure 2251) and being in the opposite orientation in immediately adjacent layers (i.e., offset-side multiple-engagement building blocks 2204 defining the second side face of the wall structure 2251 and offset-side single-engagement building block 2206 defining the first side face of the wall structure 2251). Overlapping refers to bocks in one layer being longitudinally displaced by one half of their width (e.g., one row of interlocking structures) in immediately adjacent rows of the wall structure 2251. Accordingly, this alternating and overlapping arrangement in combination with the offset face of each offset-side multiple-engagement building block 2204 and each offset-side single-engagement building block 2206 and the stepped portion 2209 of the offset-side multiple-engagement building block 2204 results in each layer of the wall structure 2251 including a wall isolation space 2216 includes vertical portions 2216*a* and horizontal portions 2216*b*. The stepped portion 2209 of each offset-side multiple-engagement building block 2204 at least partially defines the horizontal portions 2216*b* of the wall isolation space 2216.

The wall isolation space 2216 serves to at least partially isolate (e.g., thermally and/or mechanically) an exterior wall portion 2202*a* of the wall structure 2251 from an interior wall portion 2202*b* of the wall structure 2251. In doing so, the rate of thermal transfer between the exterior wall portion 2202*a* (FIG. 25) of the wall structure 2251 and the interior wall portion 1202*b* (FIG. 25) of the wall structure 2251 is advantageously reduced relative to a wall without such isolation of the wall portions. It is disclosed herein that an insulating material besides air may be deposited within all or a portion of the vertical portions 2216*a* and/or the horizontal portions 2216*b* of the wall isolation space 2216. Examples of such insulating materials include but are not limited to foam-based insulation, fibreglass-based insulation, insulation-filled grout, insulation-filled mortar and the like.

Figure 24:
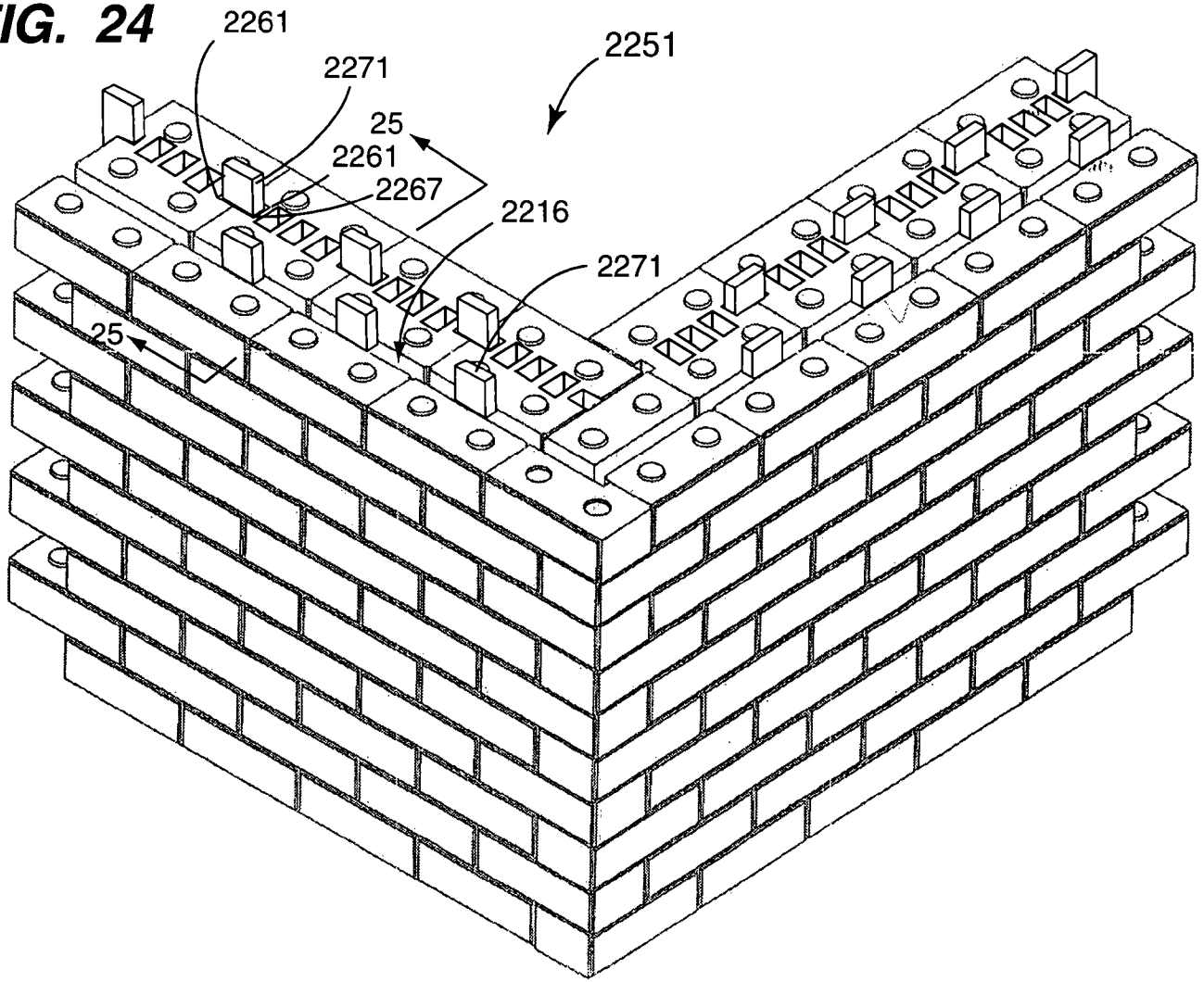
FIG. 24 depicts a third embodiment of a wall structure in accordance with the present invention, which is constructed using the building blocks of FIGS. 20 and 21.
Figure 25:
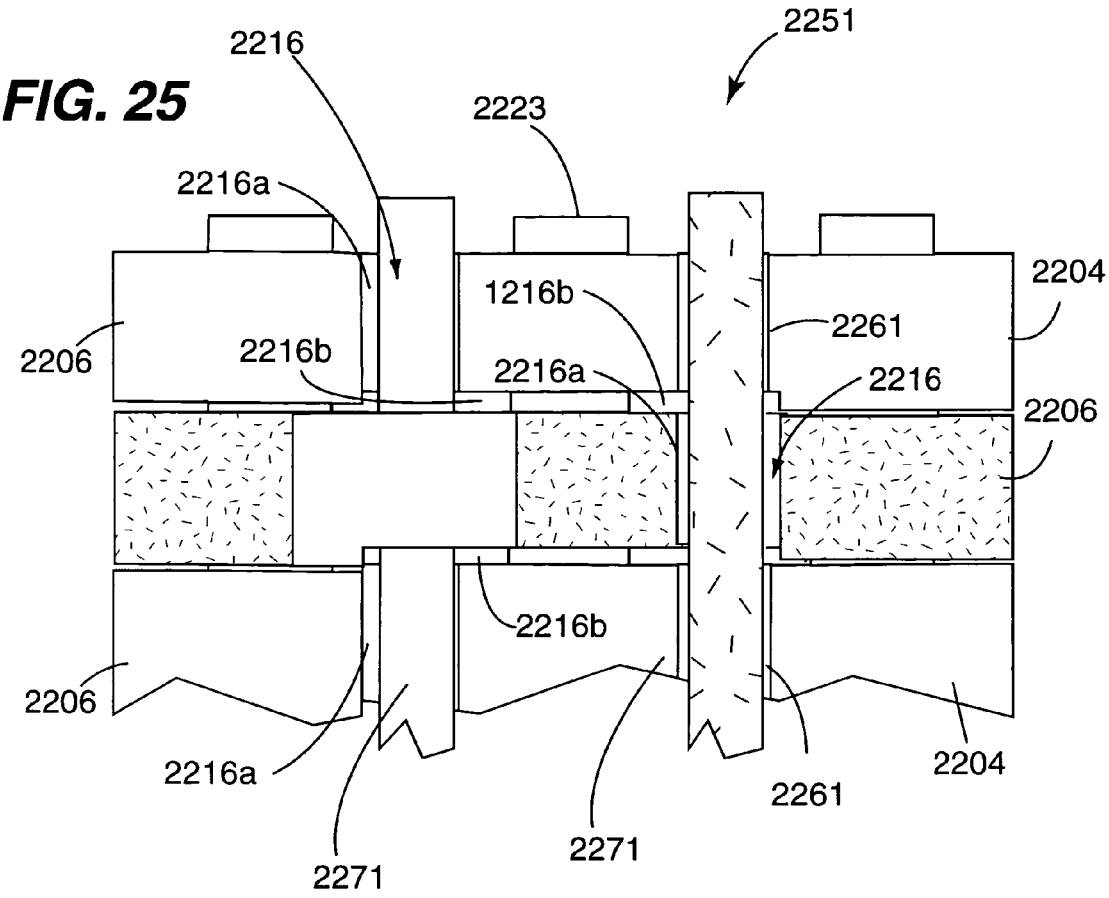
FIG. 25 is a cross-sectional view taken along the line 25-25 in FIG. 24.

Still referring to FIGS. 20-25, each offset-side multiple-engagement building block 2204 includes end face passage channels 2261. An end face passage channel 2261 is provided in the end face 2222 of each offset-side multiple-engagement building block 2204. As shown in FIGS. 24 and 25, the end face passage channels 2261 of each offset-side multiple-engagement building block 2204 are positioned such that end-to-end alignment of two offset-side multiple-engagement building blocks 2204 results in formation of a vertical end face passage 2267 extending between adjacent offset-side multiple-engagement building blocks 2204 within a layer of the wall structure 2251. The alternating and offset configuration of the wall structure 2251 (discussed above) causes each vertical end face passage 2267 in a particular layer of the wall structure 2251 to be vertically aligned with the vertical portion 2216*a* of the wall isolation space 2216 of immediately adjacent layers of the wall structure 2251. It is disclosed herein that the at least a portion of the end face passage channel 2261 can extend to the first one of the side faces 2220, whereby the end face passage 2267 is communicative with the vertical portion 2216*a* of the wall isolation space 2216.

As shown in FIGS. 24 and 25, such vertical alignment of the vertical end face passage 2267 enables a plurality of load bearing members 2271 to be vertically disposed within the wall structure 2251. The load bearing members 2271 extend through such vertically aligned end face passages 2267 from a footing or ground structure on which the wall structure 2251 is formed through a top portion of the wall structure 2251. In this manner, vertical loading from a roof structure or flooring structure, for example, can be supported by the load bearing members 2271 and, optionally, the building blocks (2204, 2206) of the wall structure 2251. Examples of each load bearing member 2271 include, but are not limited to, a wooden beam, a steel beam, steel reinforced concrete beam (i.e., a preformed masonry beam) and the like.

Figure 26:
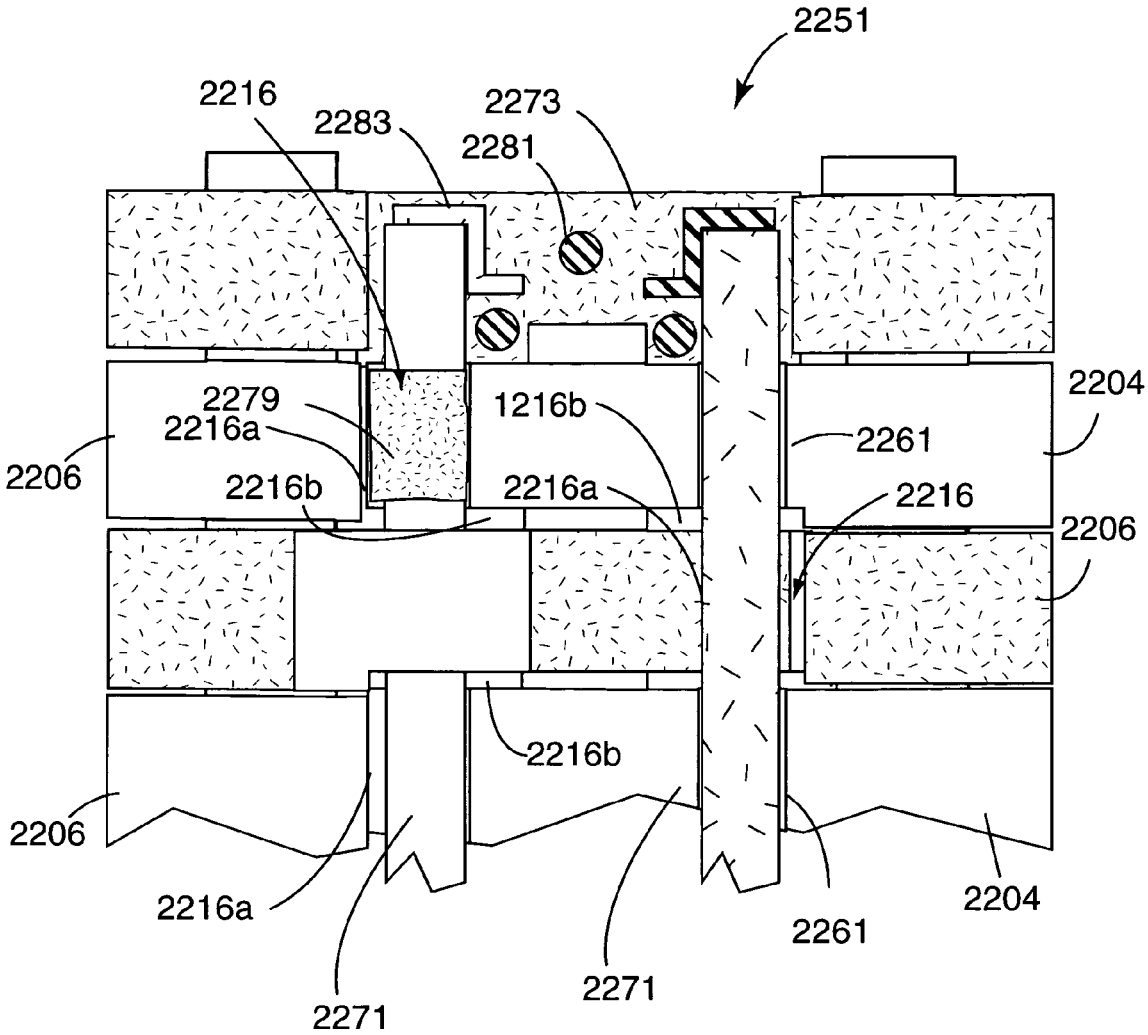
FIG. 26 is a cross-sectional showing the wall structure of FIG. 24 with a load distributing structure incorporated therewith.

Referring now to FIG. 26, a poured masonry beam 2273 extends longitudinally along a top of the wall structure 2251. The poured masonry beam 2273 is an embodiment of a load distribution structure 2273 in accordance with the present invention. Examples of flowable masonry material suitable for the poured masonry beam 2273 include, but are not limited to, concrete, mortar, cement, granite and the like. The poured masonry beam 2273 is formed over exposed upper end portions 2275 of the load bearing members 2271. The top portion of the wall structure 2251 includes two spaced apart rows 2277 of offset-side single-engagement building blocks 2206 that form a channel in which the poured masonry beam 2273 is formed. A block-off material 2279 such as, for example, foam strips or expanding foam sealant is disposed within the vertical portion 2216*a* of the wall isolation space 2216 areas to prevent the flow of concrete into the wall isolation space 2216. Beam reinforming members 2281 (e.g., steel rebar) is preferably, but not necessarily, disposed in the concrete for adding tensile and bending strength to the poured masonry beam 2273. Similarly, load distributing members 2283 may be engaged with the load bearing members 2271 for enhancing the uniformity in which loads are directed from the poured concrete beam 2273 into the load bearing members 2271.

It is disclosed herein that the offset-side multiple-engagement building block 2204 and the offset-side single-engagement building block 2206 discussed above in reference to FIGS. 20 and 21 can be used for forming an interior wall similar to that shown in FIG. 1. Such a wall formed using the building blocks (2204, 2206) of FIGS. 20 and 21 can have one of more load bearing members vertically routed through vertical passages of adjacent offset-side multiple-engagement building blocks 2204 in each respective layer and through a vertical wall space created between adjacent side faces of adjacent offset-side single-engagement building blocks 2206 in a respective layer. Furthermore, a flowable masonry material can be provided within all or a portion of the vertical wall space.

It is disclosed herein that the poured masonry material may be utilized for enhancing integrity of wall structures in accordance with the present invention, enhancing overall strength of wall structures in accordance with the present invention and/or creating structural features (e.g., door casings, window casings and the like) within wall structures in accordance with the present invention. To this end, a method for enhancing integrity of wall structures in accordance with the present invention, enhancing overall strength of wall structures in accordance with the present invention and/or creating structural features (e.g., door casings, window casings and the like) within wall structures in accordance with the present invention includes forming wall layers using building blocks disclosed herein. During formation of the wall layers, block-off material (e.g., the block-off material 2279 disclosed in reference to FIG. 26 (e.g., foam strips or expanding foam sealant)) is selectively disposed within selected wall isolation spaces, central passages and/or other passages and voids in a manner that isolates a selected portion of the wall isolation space. Through such isolation, this selected portion of the wall isolation space is selectively fillable with a flowable (e.g., pourable) masonry material after or during formation of some or all of the wall layers in the wall and the selectively applied block-off material serves to form open spaces within or adjacent to spaces filled in by the flowable masonry material. In one embodiment, placement of the block-off material is configured such that flowable masonry material within the wall isolation space forms vertical structural beams whereby a plurality of building blocks in one or more layers of the wall structure are structurally tied together. In another embodiment, placement of the block-off material is configured such that flowable masonry material within the wall isolation space forms horizontal structural beams whereby a plurality of building blocks in one or more layers of the wall structure are structurally tied together. In still another embodiment, the isolated wall isolation space forms a window or door casement space around a corresponding casement mold temporarily secured within an aperture within the wall structure such that all or a portion of the building blocks within the isolated space and any space between the building blocks and the casement mold are structurally tied together when the isolated space is filled with the flowable masonry material.

In certain embodiments of wall structures disclosed herein, the use of offset-side multiple-engagement building blocks and offset-side single-engagement building blocks for each row of blocks in a layer of the wall structure is disclosed. It is disclosed herein that, in other embodiments, the row of offset-side multiple-engagement building blocks in each layer may be replaced with non-offset-side multiple-engagement building blocks. Furthermore, it is disclosed herein that, in still other embodiments, the row of offset-side single-engagement building blocks in each layer may be replaced with non-offset-side single-engagement building blocks. The present invention is not unnecessarily limited to a particular means for providing a vertical portion of a wall isolation space.

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A building block arrangement, comprising:

layers of building blocks;

a first load bearing member; and a load distribution structure;

wherein each one of said layers includes a row of building blocks of a first configuration in end-to-end alignment and a row of building blocks of a second configuration in end-to-end alignment spaced apart from said row of building blocks of the first configuration whereby a vertical wall isolation space extends between said rows of blocks of each one of said layers;

wherein the row of building blocks of the second configuration of each layer of building blocks laterally overlaps the vertical wall isolation space of each adjacent layer of building blocks and the row of building blocks of the first configuration of each adjacent layer of building blocks;

wherein said building blocks of the second configuration each include a stepped portion in at least one of an upper face and a lower face thereof whereby the stepped portion of each one of said building blocks of the second configuration forms a horizontal wall isolation space extending between the vertical wall isolation space of adjacent layers of building blocks;

wherein a vertical end passage channel is provided in each end face of said building blocks of the second configuration whereby said end-to-end alignment of said building blocks of the second configuration results in vertical end passage channels of adjacent building blocks of the second configuration forming a vertical end face passage extending therebetween;

wherein the first load bearing member extends through vertical end face passages of a plurality of said layers, wherein at least a portion of said vertical end face passages of one of said layers is vertically aligned with a corresponding one of said vertical end face passages of each adjacent one of said layers; and wherein the load distribution structure is engaged with the first load bearing member, wherein the first load bearing member has a first end portion adjacent a lowermost one of said layers of building blocks and a second end portion adjacent an uppermost one of said layers of building blocks and wherein the load distributing structure is engaged with the second end portion of the first load bearing member.

2. The building block arrangement of claim 1 wherein the load distribution structure includes at least one of a wood beam, a metal beam, a pre-formed masonry beam and poured-in-place structural beam.

3. The building block arrangement of claim 1 wherein:

the load distribution structure is a poured-in-place structural beam made from flowable masonry material;

an elongated beam reinforcing member is disposed within said flowable masonry material; and a load distributing member disposed within said flowable masonry material is engaged with the second end portion of the first load bearing member.

4. The building block arrangement of claim 1 wherein the vertical end face passage is substantially rectangular in cross-sectional shape.

5. The building block arrangement of claim 1 wherein each vertical end face passage of one of said layers is vertically aligned with the vertical wall isolation space of each adjacent layer.

6. The building block arrangement of claim 5 wherein a width of the vertical wall isolation space is at least as wide as a width of each vertical end face passage.

7. A building block arrangement, comprising:

layers of building blocks:

a first load bearing member: and a second load bearing member:

wherein each one of said layers includes a row of building blocks of a first configuration in end-to-end alignment and a row of building blocks of a second configuration in end-to-end alignment spaced apart from said row of building blocks of the first configuration whereby a vertical wall isolation space extends between said rows of blocks of each one of said layers;

wherein the row of building blocks of the second configuration of each layer of building blocks laterally overlaps the vertical wall isolation space of each adjacent layer of building blocks and the row of building blocks of the first configuration of each adjacent layer of building blocks;

wherein said building blocks of the second configuration each include a stepped portion in at least one of an upper face and a lower face thereof whereby the stepped portion of each one of said building blocks of the second configuration forms a horizontal wall isolation space extending between the vertical wall isolation space of adjacent layers of building blocks;

wherein a vertical end passage channel is provided in each end face of said building blocks of the second configuration whereby said end-to-end alignment of said building blocks of the second configuration results in vertical end passage channels of adjacent building blocks of the second configuration forming a vertical end face passage extending therebetween;

wherein the first load bearing member extends through vertical end face passages of a plurality of said layers, wherein at least a portion of said vertical end face passages of one of said layers is vertically aligned with a corresponding one of said vertical end face passages of each adjacent one of said layers; and wherein each one of said building blocks of the first configuration includes a vertical side face passage channel in a side face thereof, wherein each one of said building blocks of the second configuration includes a vertical side face passage channel in a side face thereof, wherein said vertical side face passage channels of each layer are aligned with the vertical wall isolation space of each adjacent layer and wherein the second load bearing member extends vertically through aligned ones of said vertical side face passage channel.

8. The building block arrangement of claim 7, further comprising:

a load distribution structure engaged with the first load bearing member and the second load bearing member, wherein said load bearing members each have a first end portion adjacent a lowermost one of said layers of building blocks and a second end portion adjacent an uppermost one of said layers of building blocks and wherein the load distributing structure is engaged with the second end portion of each one of said load bearing members.

* * * * *